United States Patent [19]

Mansfield et al.

[11] Patent Number: 4,916,301

[45] Date of Patent: Apr. 10, 1990

[54] GRAPHICS FUNCTION CONTROLLER FOR A HIGH PERFORMANCE VIDEO DISPLAY SYSTEM

[75] Inventors: Robert L. Mansfield; Alexander K. Spencer, both of Austin; Joe C. St. Clair, Round Rock, all of Tex.

[73] Assignee: International Business Machines Corporation, Armonk, N.Y.

[21] Appl. No.: 298,792

[22] Filed: Jan. 17, 1989

Related U.S. Application Data

[63] Continuation of Ser. No. 13,849, Feb. 12, 1987, abandoned.

[51] Int. Cl.[4] ..... G09G 1/00

[52] U.S. Cl. ..... 340/747; 340/744; 340/799; 364/521

[58] Field of Search ..... 340/723, 744, 747, 750, 340/789, 798, 799; 364/518, 519, 521, 724

[56] References Cited

U.S. PATENT DOCUMENTS

| | | | |
|---|---|---|---|
| 4,646,259 | 2/1987 | Lincoln et al. | 340/799 |
| 4,665,495 | 5/1987 | Thaden | 340/798 |
| 4,667,306 | 5/1987 | Smith | 340/747 |
| 4,688,032 | 8/1987 | Saito et al. | 340/799 |
| 4,701,864 | 10/1987 | Takashima et al. | 340/799 |
| 4,710,761 | 12/1987 | Kapur et al. | 340/799 |

OTHER PUBLICATIONS

*Fundamentals of Interactive Computer Graphic,* by James D. Foley and Andries VanDam, published by Addison-Wesley Publishing Company, 1982, pp. 433–435.

*IBM Technical Disclosure Bulletin,* vol. 28, No. 5, Oct., 1985, "Circuit for Updating Bit Map-Memory of a Display Adapter", pp. 2240–2243.

*IBM Technical Disclosure Bulletin,* vol. 27, No. 8, Jan., 1985, "Raster Graphics Drawing Hardware", pp. 4618–4622.

*IBM Technical Disclosure Bulletin,* vol. 28, No. 6, Nov., 1985, "Graphic Bit-Blt Copy Under Mask", pp. 2721–2724.

*Primary Examiner*—Jeffrey A. Brier

*Attorney, Agent, or Firm*—Thomas E. Tyson

[57] ABSTRACT

A processing system is provided that includes an external device connected to a processor. The external device has the capability of responding to external device commands wherein each of these external device commands is performed within at least one fixed time cycle. The processor provides these external device commands and, further, includes the means for executing instructions that not only specify the external device commands but also specify at least one internal command to be performed by the processor simultaneously with the performance of the external device command and within the same fixed time cycle. In the disclosed embodiment, a graphics display system is provided that includes a system processor, a graphic processor, a graphics memory and a display device. The graphics processor receives instructions from the system processor which specifies commands to be executed by both the graphics processor and the graphics memory. Each graphics memory command is executed within a fixed time cycle simultaneously with the execution of a corresponding graphics processor command executed within the graphics processor.

20 Claims, 21 Drawing Sheets

| | | | |
|---|---|---|---|
| 3 | 2 | 1 | 0 |
| 7 | 6 | 5 | 4 |
| 11 | 10 | 9 | 8 |
| 15 | 14 | 13 | 12 |

GRAPHICS FUNCTION CONTROLLER FOR A HIGH PERFORMANCE VIDEO DISPLAY SYSTEM

This is a continuation of application Ser. No. 013,849 filed Feb. 12, 1987, now abandoned.

CROSS REFERENCE TO RELATED COPENDING APPLICATIONS

U.S. patent application No. 013,842 entitled "A High Resolution Graphics Display Adapter" filed Feb. 12, 1987, now U.S. Pat. No. 4,870,406 relates to an overall high function video display adapter in which architecture of the present invention has particular utility.

U.S. patent application No. 013,848 filed Feb. 12, 1987, now U.S. Pat. No. 4,816,814 entitled "Vector Generator With Direction Independent Drawing Speed For An All Point Addressable Raster Display" discloses a novel vector line drawing circuit for use with raster scan type video displays and having both improved speed and versatility of function.

U.S. patent application No.013,847 filed Feb. 12, 1987, now U.S. Pat. No. 4,823,286 entitled "Pixel Data Path For High Performance Raster Displays With All Point Addressable Frame Buffers" discloses a channel architecture which could be utilized in the data path feeding the frame buffer of such an adapter and which enables a number of versatile pixel data operations within the frame buffer. The hardware of this application would be located within the pel processor "block" of application Ser. No.

U.S. patent application No. 013,843 filed Feb. 12, 1987, entitled "A Frame Buffer Capable of Accessing Aligned Square Words of the Screen" discloses a frame buffer architecture which permits a substantial increase in the speed of a number of display operations as well as enhancing the versatility of the adapter in terms of the functions that may be performed off line. The hardware of this application would be located in the "frame buffer" block of application No. 013,842.

U.S. patent application No. 013,841 filed Feb. 122, 1987, now U.S. Pat. No. 4,837,563 entitled "A Graphics Display System Function Circuit" discloses a graphics function address circuit similar to that set forth in the above referenced U.S. patent application No. 013,848 which is uniquely suited to the overall video display adapter architecture set forth in the above referenced application Ser. No. 013,842.

U.S. patent application No. 013,840 filed Feb. 12, 1987, now U.S. Pat. No. 4,808,906 entitled "A Memory Array Access Circuit For A High Performance Video Display System" discloses additional circuitry for performing function in the "pel processor" block of application Ser. No. 013,842. This application specifically relates to circuitry for controlling pel data provided to the frame buffer of the video adapter and includes controllable write mask used in storing pel data in this associated frame buffer.

TECHNICAL FIELD

The present invention relates to a computer graphics and more specifically to a control apparatus for regulating the execution of commands in both a graphics processor and an external graphics memory simultaneously.

BACKGROUND ART

The evolution of computer technology has resulted in the creation of a sophisticated technical area devoted to the representation of graphics information generated by computers. This area is termed computer graphics. One graphics technique commonly used to produce an image is that of producing a set of points and connecting these points with straight lines. The resulting combination of points and straight lines are displayed on the computer graphics terminal display which normally includes a cathode ray tube (CRT). The cathode ray tube includes an array of picture elements. The graphics image is produced by illuminating selected picture elements of the array. This array of picture elements in a display corresponds to the memory locations in an image memory. This image memory is often termed a bit map memory. The corresponding CRT display is termed a bit mapped display.

A very useful function for bit map displays is the ability to move a rectangular block of illuminated picture elements (pels) from one place in the bit map (or display) to another place and to logically combine two subsets of the image array to produce a third image array. Another useful function is that of drawing lines between two points. The technique often used to draw these lines is disclosed in a text entitled *Fundamentals of Interactive Computer Graphics* by James D. Foley and Andries Van Dam published by Addison Wesley Publishing Company, 1982 and herein incorporated by reference.

Discussions of graphic functions are contained in several IBM Technical Disclosure Bulletins. *IBM Technical Disclosure Bulletin*, Vol. 28, No. 6, November 1985, entitled "Graphic Bit-Blt Copy Under Mask" discloses a system for making bit boundary block transfers of arbitrary shapes within a frame buffer. *IBM Technical Disclosure Bulletin*, Vol. 27, No. 8, 1985, entitled "Raster Graphics Drawing Hardware", describes the application of programmable logic arrays to the design of hardware circuitry implementing graphics drawing algorithms. *IBM Technical Disclosure Bulletin, Vol.* 28, No. 5, October 1985, entitled "Circuit for Updating Bit Map-Memory of A Display Adapter", discloses a circuit for providing bit manipulation flexibility to control picture element data stored in an all points addressable display memory.

An object of the present invention is to provide a controlling mechanism for an graphics processor and an graphics memory for rapidly accomplishing bit block transfers and line draw functions.

DISCLOSURE OF THE INVENTION

In accordance with the present system, a processing system is disclosed including an external device that responds to several external device commands where each of these commands are performed within a single fixed time period. The processing system also includes a processor connected to this external device to provide the external device with the external device commands. The processor includes circuitry for executing instructions that specify these external device commands and at least one internal command where the internal command is to be performed in the processor simultaneously with the performance of the external command by the external device.

In the preferred embodiment of this invention, the external device is a memory storage device that receives load and store commands from a processor. During the time that these load and store commands are being responded to by the memory, the processor also performs commands internally. These simultaneously executed processor commands perform, in certain instances, addressing computations to compute the addresses for successive memory commands. The simultaneous computation of commands internally increases the throughput capability for the processor and memory combination.

This preferred embodiment is disclosed in a graphics display system that includes a system processor, a graphics processor, a graphics memory and a display. The system processor provides graphics information to the graphics processor. The graphics processor provides the memory commands to the graphics memory and includes the capability to execute simultaneously with the memory command executions, internal processor commands. In this embodiment, the graphics processor provides picture element data to the graphics memory. The graphics memory includes a memory array for storing the picture element data. This memory and this image array corresponds directly to the display image to be displayed. The display is connected to the graphics memory for directly accessing the picture element data in this memory array.

Another aspect of the present embodiment includes control circuitry in the graphics processor. This control circuitry is connected to several registers. The registers are accessible by the system processor to receive instructions from the system processor. These instructions specify commands for both the memory and the graphics processor. The control circuitry provides for the execution of these commands in these registers in a serial loop fashion.

BRIEF DESCRIPTION OF THE DRAWING

The novel features believed characteristic of the invention are set forth in the appended claims. The invention itself, however, as well as other features and advantages thereof, will be best understood by reference to the following description of the preferred embodiment, when read in conjunction with the accompanying figures, wherein:

BEST MODE FOR CARRYING OUT THE INVENTION

This invention is included in a computer terminal display adapter circuit. This adapter circuit is a high resolution graphics display adapter that in the preferred embodiment drives an IBM 5081 display monitor unit. This circuit provides a resolution of 1024 by 1024 picture elements with 256 simultaneous colors from a palette of 4,096 possible colors. A general description of this display adapter circuit follows.

Display Adapter—General Description

Figure 1:
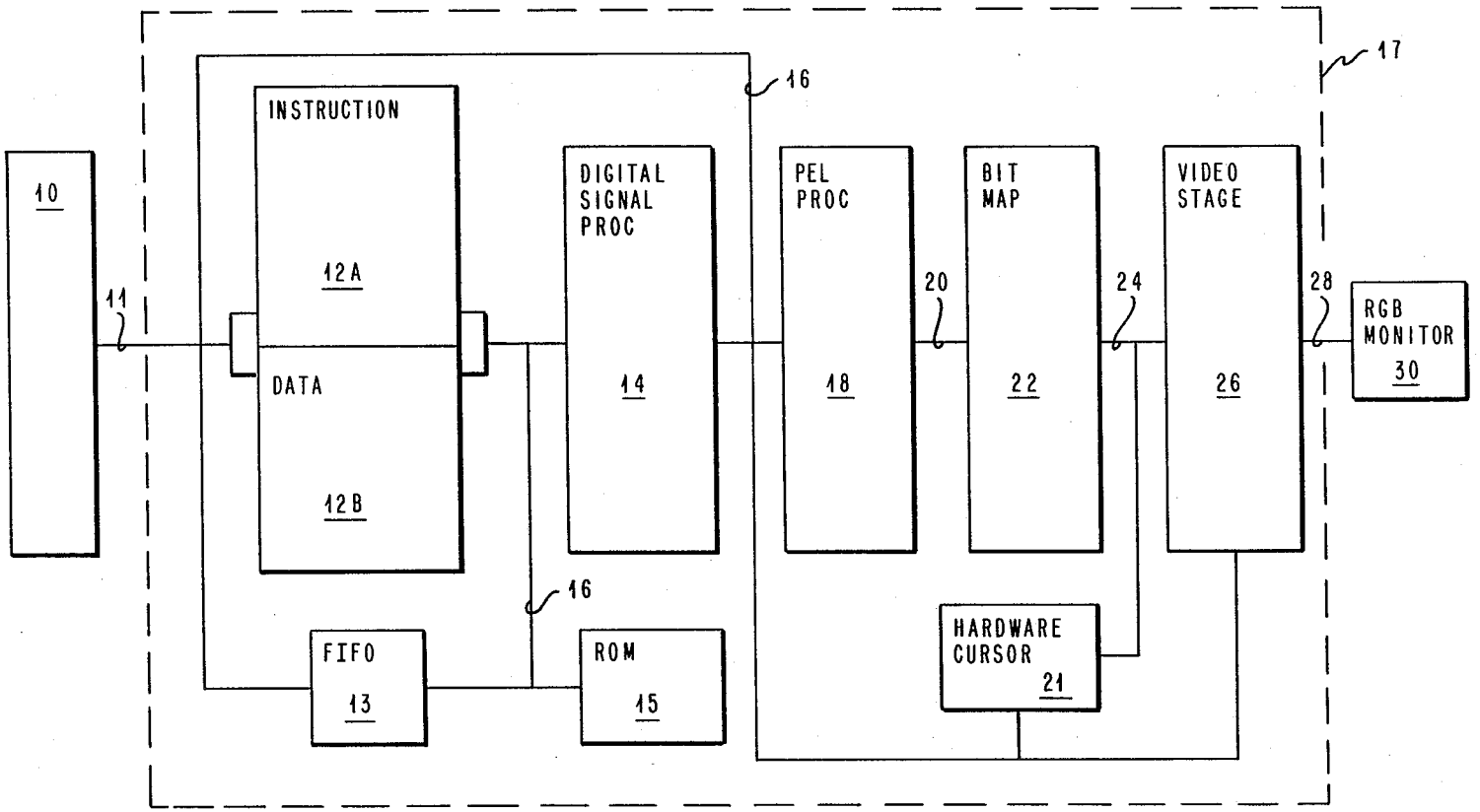
FIG. 1 is a block diagram illustrating display adapter connected to a processor and monitor.

FIG. 1 is a block diagram illustrating the display adapter circuit 17 connected for operation. Specifically, display adapter circuit 17 is connected to a system processor 10 by a system I/O bus 11. Additionally, the adapter circuit 17 is connected to a RGB monitor 30 by an output bus 28. The display adapter circuit 17 includes two memories 12A and 12B that are connected to a digital signal processor which is used for circuit resource management and is further used to transform coordinates. In the preferred embodiment, the digital signal processor is of a Harvard architecture requiring separate memories for data and instructions. Memory 12A is an instruction RAM that is loaded with microcode to provide instructions to the signal processor 14. The memory 12B is a data RAM that provides a primary interface between the signal processor 14 and the system processor 10 and also forms the main data store for the signal processor 14. In the preferred embodiment, 256K bytes of memory are provided for memory 12B. In this embodiment, however, the digital signal processor 14 has an address space of only 128K bytes. Therefore, a bank switching mechanism is provided. Furthermore, in this preferred embodiment memory located outside of the adapter circuit 17 may be mapped into the digital signal processor 14 address space.

A first-in, first-out buffer 13 is provided for passing sequential display commands from the data memory 12B to the digital signal processor 14. Further, an instruction ROM 15 is connected via bus 16 to provide the power on and self-test instruction microcode programs for the digital signal processor 14.

A pel (picture element) processor 18 is also connected to bus 16. The function of the pel processor 18 is to draw lines, provide for manipulation of areas of data on the display screen and provide bit map memory control. This manipulation of areas on the display screen is termed bit block transfer or BITBLT. The pel processor 18 also includes control and status registers that along with other functions allow the system processor 10 to interrupt, disable or reset the signal processor 14 and allow the signal processor 14 to interrupt the system processor 10.

The pel processor 18 is connected via bus 20 to a bit map memory 22. The bit map memory 22 is organized as 1024 by 1024 by 8 bits. The bit map memory 22 also includes the capability to provide an overlay plane that can be used to provide blinking or highlighting to data on the display.

A video stage 26 is connected to the bit map memory 22 via bus 24 and transforms the data in the bit map memory 22 into a video signal for the video monitor 30. This video stage 26 provides this transformation via a digital to analog circuit. A color palette circuit is also included in the video stage 26 that provides 256 simultaneously displayable colors from a larger palette of colors. This is accomplished through video lookup tables that translate the value in the bit map to a value with more bits and thus a greater range of colors is provided. With this greater range of values provided by the color palette, more colors are provided than would be provided by use of the bits in the bit map memory 22 alone.

A hardware cursor 21 is connected to the video stage 26 via bus 24 and provides a full screen cross hair and/or a bit programmable cursor. The full screen cross hair can be programmed to one of several widths. In addition this cross hair can also be scissored (reduced in size) to provide various smaller sizes.

In the preferred embodiment, the display adapter circuit 17 uses the digital signal processor 14 as a primary interface to the system processor 10. In this embodiment, the digital signal processor is a Texas Instruments TMS 32020 digital signal processor which executes 5 million instructions per second. Therefore, it is well suited to perform such tasks as matrix multiplications which are used to translate, scale and rotate vectors on the screen. The digital signal processor can address a data space of 64K of 16 bit words and an instruction space of the same size. As mentioned earlier, a portion of the data space may be located within the adapter circuit 17 or remote from the adapter circuit 17. The digital signal processor 14 can be interrupted by the system processor 10 or by the pel processor 18. The pel processor 18 can generate interrupts to the digital signal processor 14 or the system processor 10 upon the occurrence of a task complete condition or the condition where a vertical retrace has been started. In addition, the digital signal processor 14 also includes a timer which can be used to control the time between display updates.

The ROM 15 is provided with the initial power-up instruction sequence for the digital signal processor 14. In the preferred embodiment, the ROM 15 is provided with 16K bytes of information and includes a power-on self-test program and a graphics display adapter emulation program. The power-on self-test program provides an indication that immediately after a power-up condition or a reset condition that the adapter circuit 17 is functioning properly.

The data RAM 12B provides 256K bytes of RAM in the adapter circuit 17 for the signal processor 14 to use as storage. 1K byte of the 256K byte data space is overlayed by the signal processor 14 internal registers. The data memory 12B consists of dynamic RAM, which is refreshed by logic within the display adapter circuit 17. This memory is operated in a page mode so that accesses to two words loaded on the same page (i.e., in the preferred embodiment in the high order 8 address bits) will require no wait states for the digital signal processor 14. Accesses to words on a new page will result in a single wait state. Thus, locating frequently referenced data in internal registers or grouped together on a single RAM page will increase performance by not incurring any wait states. Although the digital signal processor 14 data addressing capacity is limited to 64K words, a bank switching mechanism is provided to extend its address space. This scheme allows a full access to the data memory 12B. Presently, four banks (64K bytes for each bank for a total of 256K bytes) have been implemented. However, the address logic in architecture may provide for up to 16 banks in this preferred embodiment. In this embodiment, the RAM is dual ported, that is the system processor 10 and the signal processor 14 have concurrent access to it. Since both processors 10 and 14 have easy access to this memory, it provides for a convenient communications channel between the two processors 10 and 14. In this embodiment, the signal processor 14 can also address memory located remote from the display adapter circuit 17 as an extension of this data RAM 12B, by first acting as a first party bus master on bus 11. Both memory on the I/O bus 11 and within the system processor's 10 main memory may be accessed in this manner. The signal processor 14 can put a full 24 bit address on bus 11 and so has a potential of addressing 16 megabytes of memory. The mapping of data space remote from the adapter circuit 17 is controlled by a Bank/Extended Address Register within the signal processor 14. The 16 bit address bus of the signal processor 14 is extended to 24 bits with this register. Access may be made in burst mode, buffered mode, or singly. The length of the burst in burst mode is software controllable. Four to sixteen wait states are required for access to remote memory.

The instruction memory 12A provides 128K bytes of memory in the preferred embodiment to the digital signal processor 14 to use as an instruction space. This is in addition to the instruction space provided by ROM 15. However when the ROM 15 is mapped into an instruction space, it overlays an equivalent amount of instruction RAM 12A. This is done because the digital signal processor 14 can only address a total instruction space of 128K bytes. The instruction memory 12A consists of dynamic RAM which is refreshed by logic on the adapter circuit 17. The instruction RAM 12A is operated in a page mode so that access to words located on the same page (i.e., the high order 8 bits) requires no wait states for the signal processor 14. Accesses to a new page results in one wait state. Therefore, locating frequently executed code loops on the same page within the instruction memory 12A or within the signal processor 14 internal instruction memory will provide a maximum execution speed. This instruction memory 12A is also dual ported providing concurrent access from the system processor 10 or the signal processor 14.

The FIFO buffer 13 is 1K words in length. When there is space in buffer 13, the system processor 10 may load commands and/or data into this buffer providing access to the digital signal processor 14 which can then sequentially access this information. In this embodiment, display information from the system processor 10 is provided. The buffer 13 includes three flags: empty flag, half full flag and full flag which can be read by the system processor 10 to determine if there is room to write more information into this buffer 13. In addition to the flags, this buffer 13 has three interrupts associated with it. A half full interrupt, a half empty interrupt and a buffer overflow interrupt are provided. The first two may be used to pace write operations to the buffer 13 without polling the flags, while the last would normally be considered an error condition. The digital signal processor 14 also has access to the flags to determine if more information can be read from the buffer 13.

The pel processor 18 assists the signal processor 14 in updating the bit map memory 22 quickly. The pel processor 18 can either draw lines into the bit map memory 22 or manipulate rectangular blocks of data bits (BITBLT) in the bit map memory 22. When line drawing, the pel processor 18 can either be given the end points of the line, with Bresenham's parameters calculated by the pel processor 18, or the end points along with the parameters needed by the Bresenham's incremental line drawing algorithm. The latter approach allows more control over the vector to raster translation and may be useful for special cases such as wide lines. In addition, line attributes of color and pattern are supported directly by the pel processor 18. Support of the line width attribute requires some intervention by the signal processor 14. Lines may be drawn in replace mode, exclusive OR mode, or line on line mode.

Bit block transfers are also performed by the pel processor 18. Some of the bit block transfers operate with minimal processor intervention while others require more intervention. The bit block transfer includes the operation of an inner loop and an outer loop and the implementation in this embodiment provides that the inner loop may be either horizontally or vertically oriented. This option is particularly useful when transferring images of character strings to the bit map memory 22. In addition, the pel processor 18 has the ability to provide bit block transfers with color expansion. Color expansion is defined as the process of taking data in which each active bit represents a pixel of a known color and a zero indicates transparency (i.e., the frame buffer is not altered for this pixel location). This mode offers a performance advantage as each word of data represents 16 pixels of screen memory rather than 2.

When using color expansion, a special feature associated with the Direct Write Mask, a capability of the pel processor 18, allows the object being transferred to be rotated in any one of four possible 90 degree orientations.

The digital signal processor 14 or the system processor 10 can define an active region of the bit map memory 22 where drawing occurs. For line draw and block transfer operations, only pels that are to be drawn in this active region will be written to the bit map memory 22. Line draw and block transfer operations resulting in drawing outside of this area will be performed but the resulting pel information will not be written to the bit map memory 22. The use of this active drawing region is termed scissoring.

A further feature of the pel processor 18 is the pick window. This window can be defined to the pel processor 18 and when enabled any access to the frame buffer within this window causes an interrupt to the signal processor 14. This can be used while drawing objects to identify any part of the object which falls within the specified window.

The pel processor is normally controlled by the signal processor 14, however, the system processor 10 may disable the signal processor and control the pel processor 18 directly. The pel processor 18 will be discussed in more detail later.

The bit map memory 22 consists of 1 megabyte of video RAM. The bit map memory 22 is displayed on the screen as a 1024 by 1024 pel image with 8 bits per pel. The pel processor 18 acts as the interface between the system processor 10 or signal processor 14 and the bit map memory 22. Depending upon how some of the bits located within the pel processor 18 are set, the bit map memory 22 will be read as either two horizontally adjacent pels or four horizontally adjacent half pels (wherein a half pel is defined as either the first four or last four bits of a full pel). In all addressing modes, the bit map memory 22 is pel addressable. That is, X and Y address registers in the pel processor 18 are used to indicate the pel being addressed.

Figure 2:
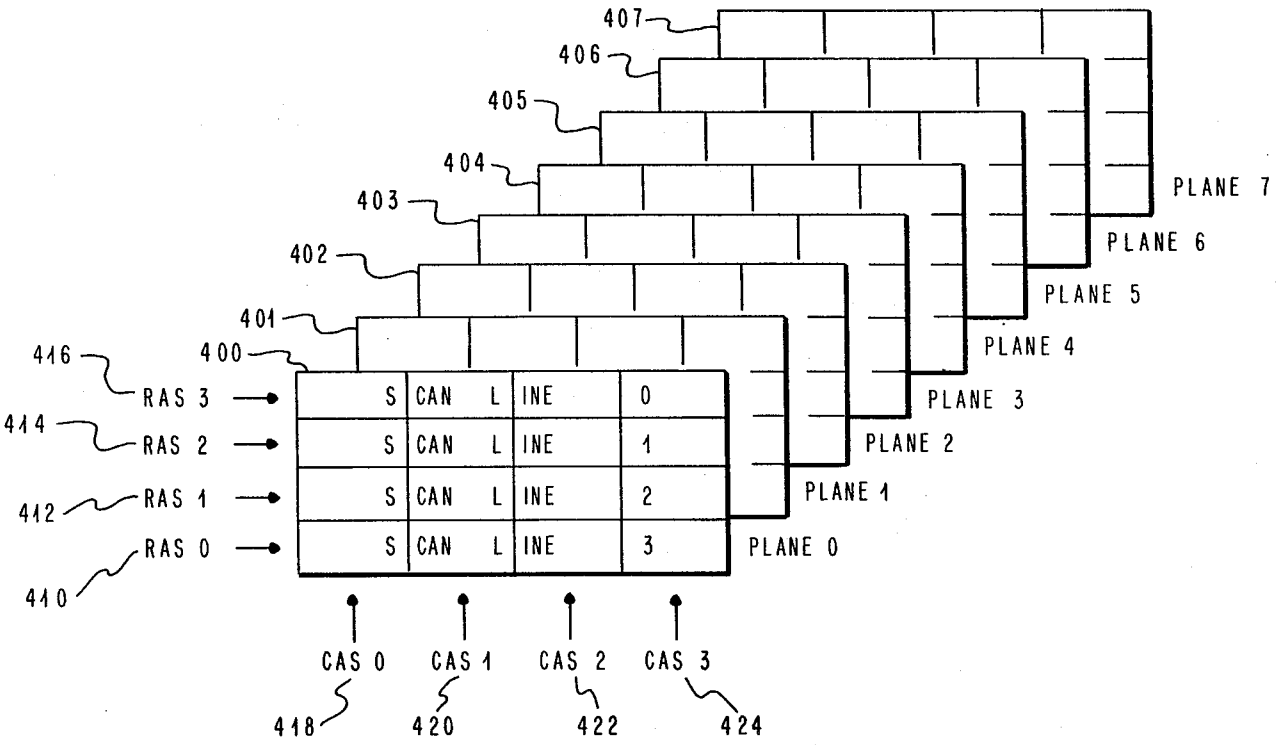
FIG. 2 is a diagram illustrating the organization of the bit map memory 22.

The organization of the bit map memory 22 is shown in FIG. 2. The pels are arranged in 4×4 squares. Each pel is 8 bits deep. The 8 bits represent 8 planes 400 through 407. Pel memory modules on the same rows share a common row address strobe (RAS) line. Those in the same column share a common address strobe (CAS) line. The same address lines are shared by all the pel memory modules. Both the serial data lines used to refresh the screen and the parallel data lines used to read and write the bit map are connected in columns. Thus, data can be read from one of four layers and loaded into accumulators. Each of the 16 pel memory modules in the 4×4 array has its own write enable that is controlled by the direct mask register and the Bresenham line drawing circuits in the pel processor 18.

Figure 3:
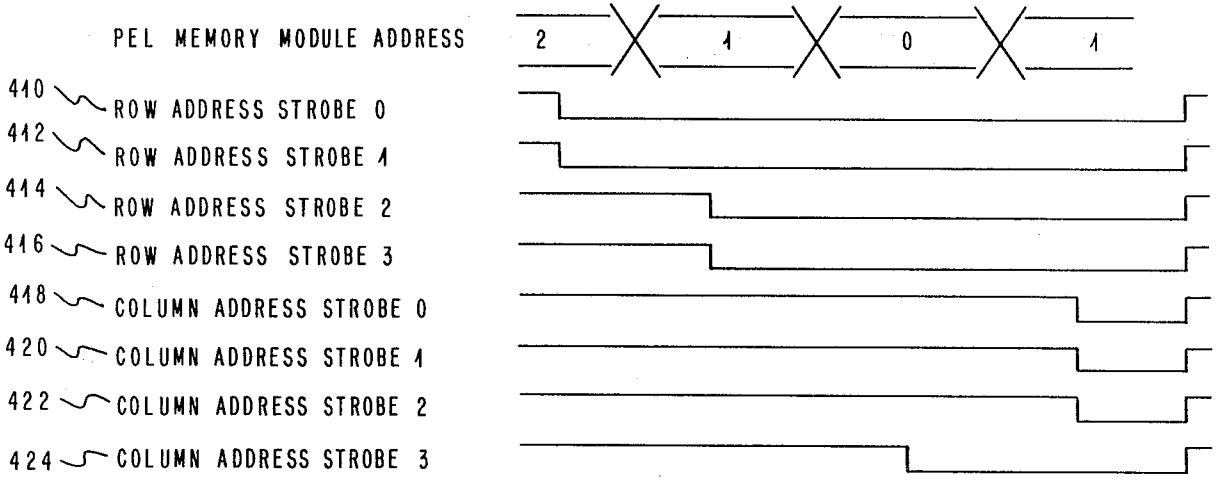
FIG. 3 is a timing diagram illustrating the timing control signals provided to the bit map memory 22 from the pel processor 18.
Figures 4, 5:
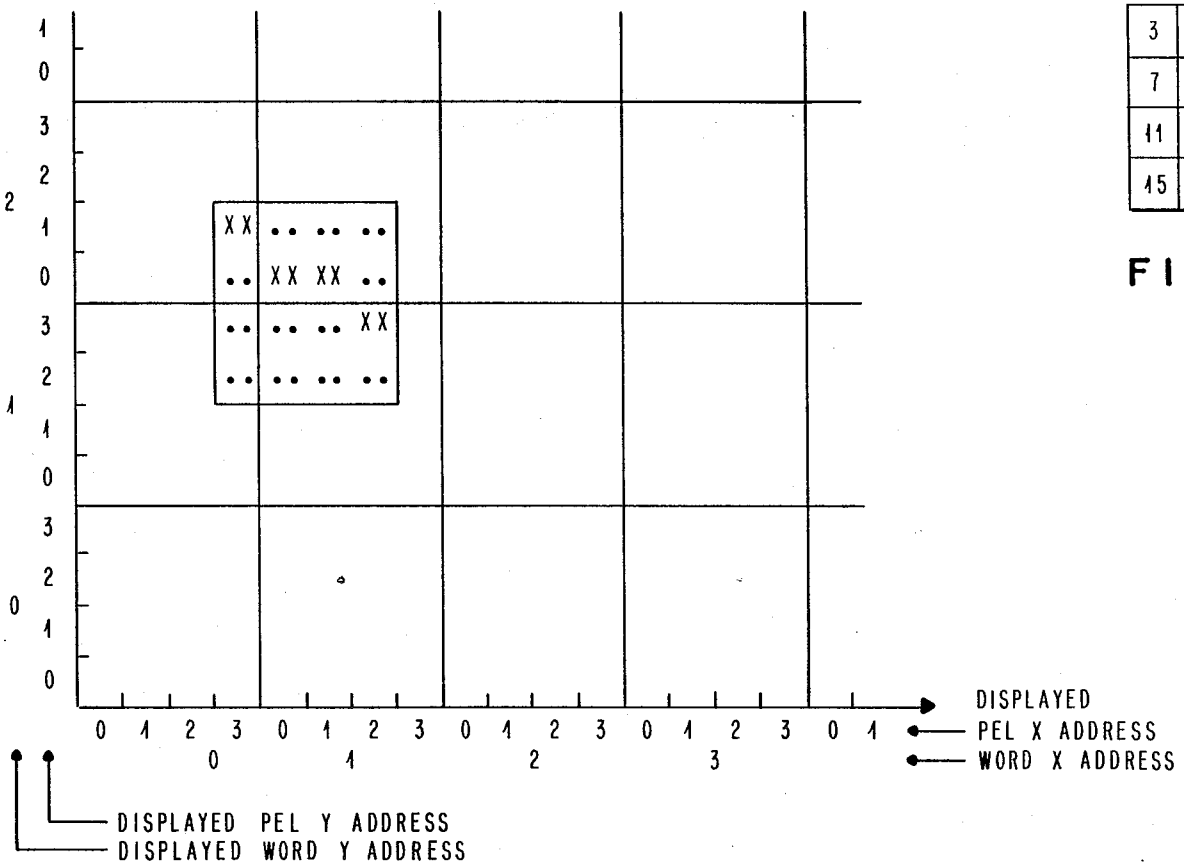
FIG. 4 is an illustration of a portion of a display screen illustrating the display of a 4×4 pel matrix upon a grid display.
FIG. 5 illustrates the address convention for a 4×4 pel matrix.

The multiple RAS lines 410, 412, 414, and 416 and the multiple CAS lines 418, 420, 422, and 424 are used to strobe different addresses in the pels. This allows the "access" 4×4 square word that is addressed by the X and Y pel address registers to be misaligned with the displayed words that are scanned onto the screen. FIG. 3 shows the waveforms for the RAS lines 410, 412, 414, and 416 and the CAS lines 418, 420, 422, and 424 that are used to strobe the addresses into the pel memory 22 and align the access word with respect to the displayed words. Note that this pel alignment of 4×4 words allows a corner of the square to be placed at the start of any line being drawn and, because each pel memory module has an independent write enable, 4 pels of the line can be drawn simultaneously as illustrated in FIG. 4. FIG. 5 illustrates the numbering of the pels in the 4×4 array.

An overlay plane, actually plane 7 (407 in FIG. 2) of the bit map memory 22 can be used in conjunction with the color palette feature of the video stage 26 to provide highlighting or blinking at a programmable rate. With blinking enabled any pixel with a 1 in this plane will blink at the programmable blink rate. With highlighting enabled a 1 in the overlay plane overrides the normal color palette process in the video stage 26 and substitutes a color from a three entry overlay color palette. Note that the use of the overlay plane will effectively reduce the available colors for the color palette feature in the video stage 26.

Returning to FIG. 1, the video stage 26 includes a color palette feature. The color palette translates the 8 bit value stored in the bit map memory 22 into one of 4,096 colors. The output of this color palette feature provides 4 bits to each of 3 digital to analog convertors. The digital to analog convertors in turn drive the red, green and blue color guns of the monitor 30. Each 4 bit section of the look-up table maps the 8 input bits from the bit map into one of sixteen analog output levels. The color palette feature may be loaded by the signal processor 14 or when the signal processor 14 is disabled, by the system processor 10.

The hardware cursor 21 provides a full screen cross hair and/or a 64×64 user programmable cursor. The full screen cross hair can be programmed to one of several widths and scissored. The output of the hardware cursor is fed to the color palette feature of the video stage 26.

In FIG. 1, the system processor 10 provides high level graphics orders to the signal processor 14. Status and other information is passed from the signal processor 14 to the system processor 10. The signal processor 14 breaks down the high level graphics orders from the system processor 10 into a series of low level graphics commands which are then passed to the pel processor 18 via the input bus 16. This input bus 16 includes address, data and control information. If the signal processor 14 has been disabled, the system processor 10 can transfer low level commands and retrieve data directly from the pel processor 18 by means of the input bus 16. Access to the bit map memory 22 is controlled by the pel processor 18. The accesses to the bit map memory 22 take place over bus 20 which provides address data and control information.

Pel Processor—Description

Figure 6:
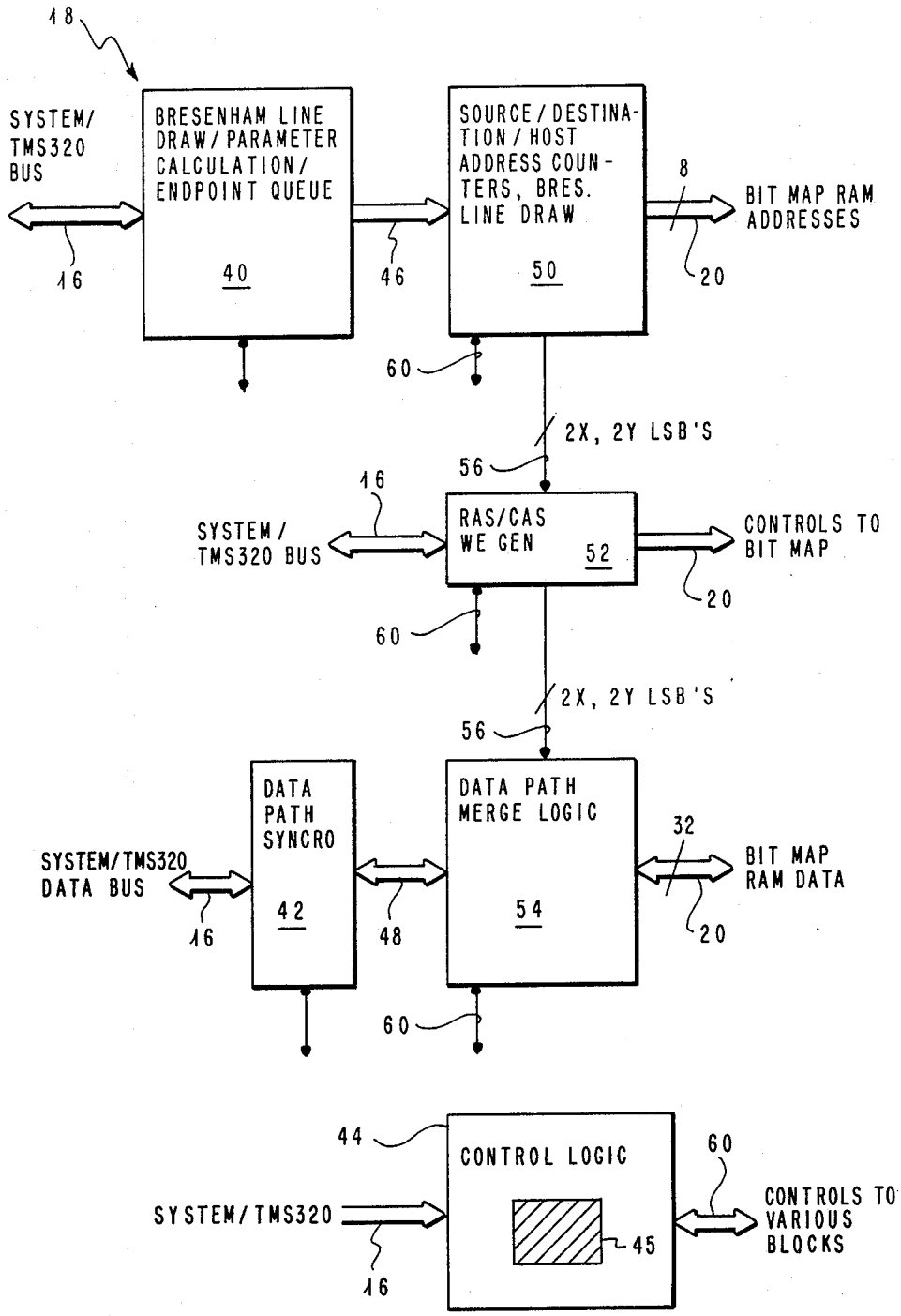
FIG. 6 is a block diagram of the pel processor 18.

A block diagram of the pel processor 18 is shown in FIG. 6. Control of the bit map memory 22 in execution of low level graphics command is achieved by writing control parameters from either the system processor 10 or the signal processor 14 into the pel processor control logic 44 via the input bus 16. These parameters are decoded within the dynamic control mechanism 45, generating control and timing signals for the other parts of the pel processor circuitry and which are provided via line 60. The endpoint address information for a low level order is communicated to the pel processor 18 by the pel processor input bus 16 and stored in the input queue contained in the endpoint logic 40. Depending on the order being processed (either line draw or bit block transfer), various operations are performed. If a line draw order is being executed, the endpoint data is used to calculate parameters used in executing Bresenham's line draw algorithm in the address count logic circuitry 50. For block transfer operations, the endpoint logic 40 simply queues the input data until this data can be transferred to the address count logic 50. Communications of the endpoint and line draw parameters from the endpoint logic 40 to the address count logic 50 takes place over the address/parameter bus 46. When these parameters have been loaded into the address count logic 50, the endpoint logic 40 is free to accept new endpoint data for the next graphics order. The address count logic 50 uses the parameters to generate the bit map addresses needed to complete the order being executed, and, in addition uses some parameters to sequence the task and determine when the task has been completed.

The address count logic 50 manipulates coordinates in 10 bit fields. The upper 8 bits of the field form the bit map memory addresses 20. The lower 2 bits of both the X and Y coordinates are passed to the RAM control logic 52 via the pel bus 56 where they are decoded into bit map control signals on line 20. These bits are also passed to the data path merge logic 54 via the pel bus 56 where they are used to control data being stored into or retrieved from the bit map memory 22. The data path merge logic 54 serves as the bridge between the system and display processor buses and the bit map memory data bus 20. System processor 10 data can be transferred between or combined with bit map data using the merge logic 54. Data being transferred to and from the system processor 10 is controlled by the data path synchronization circuitry 42 and passed via the merge bus 48.

Figure 7A:
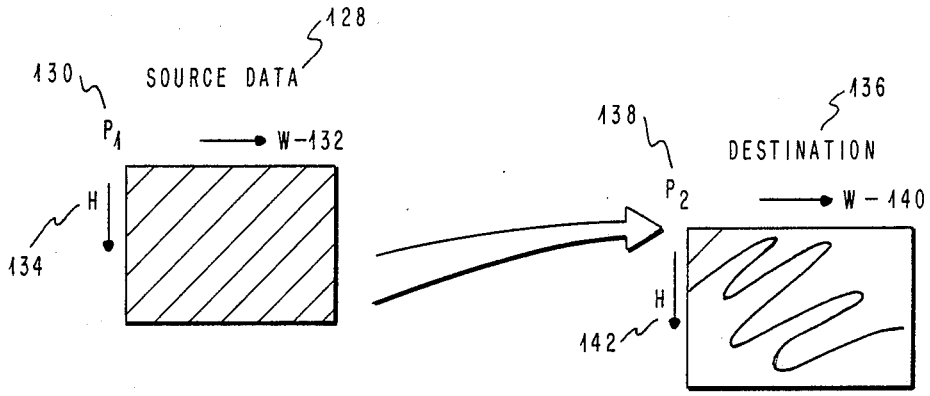
FIG. 7A illustrates a bit block transfer function.
Figure 7B:
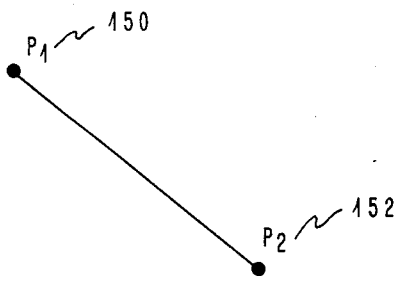
FIG. 7B illustrates a line draw function.

The following is a more detailed explanation of the two main graphics tasks that are performed by the pel processor 18. These two tasks are illustrated in FIGS. 7A and 7B. The bit block transfer task (FIG. 7A) consists of moving rectangular blocks of data from a source area of the bit map memory 22 to a destination area of the bit map memory 22. This task is commonly used to "scroll" information on the screen or to display a pop-up menu. Line drawing (FIG. 7B) which consists of connecting two points in the bit map memory 22 via straight line, is also a commonly used function. Both of these tasks form the foundation of higher level graphics operations, such as multiple source bit block transfers, pattern lines, polygon drawing, etc. For this reason, it is essential to perform these base functions as effectively as possible.

In FIG. 7A, it is desired to move a data block from location 128 to location 136. In order to perform a bit block transfer from the source location 128 to the destination location 136, the following sequence of events must take place within the pel processor 18. Once the pel processor 18 control logic 44 (FIG. 6) is loaded with control parameters to perform a bit block transfer operation, the endpoint data for P1 (130) and P2 (138) along with the height parameter (134) and the width parameter (132) are loaded into the endpoint logic 40 (FIG. 6). In executing a bit block transfer operation, the endpoint logic serves as an intermediate level of storage, passing the parameters to the address count logic 50 (FIG. 6) when the task is initiated. Loading the Y address value of P2 (138) signals the pel processor 18 to begin task execution. At this point, the address and parameter counters within the address count logic begin to access the bit map memory locations along with the width dimension of the bit block transfer, alternately accessing the source, then the destination addresses. When a string of accesses is completed along the width dimension, the address counters are automatically counted and reloaded to begin the next line. This process continues until the bottom of the bit block transfer is reached. The address counters generate a 10 bit pel address, and the upper 8 bits are used as the bit map memory address 20, while the lower 2 bits 56 are used as the pel decode in the RAM control logic 52 (FIG. 6), and the merge logic 54. The merge logic 54 takes the data read in from the source location, aligns it, and passes it out to be stored in the destination locations.

FIG. 7B illustrates a line draw task. In order to perform a line draw command, the end points of the line, P1 (150) and P2 (152) are loaded into the endpoint logic 40 (FIG. 6). Loading the Y address value of P2 (152) signals the pel processor 18 to begin execution. At this point, the endpoint logic begins to calculate the various Bresenham parameters associated with the line to be drawn. Once this calculation process is finished, the parameters are passed to the address count logic 50. To execute this line draw task, the address count logic will begin generating pel addresses for each pel in the line. The upper 8 bits of the address will serve as the bit map address 20 as before. The lower 2 bits 56 of the pel address are passed to the RAM control logic 52, where they are used to generate the appropriate write enables to draw the line into the bit map.

Figure 8A:
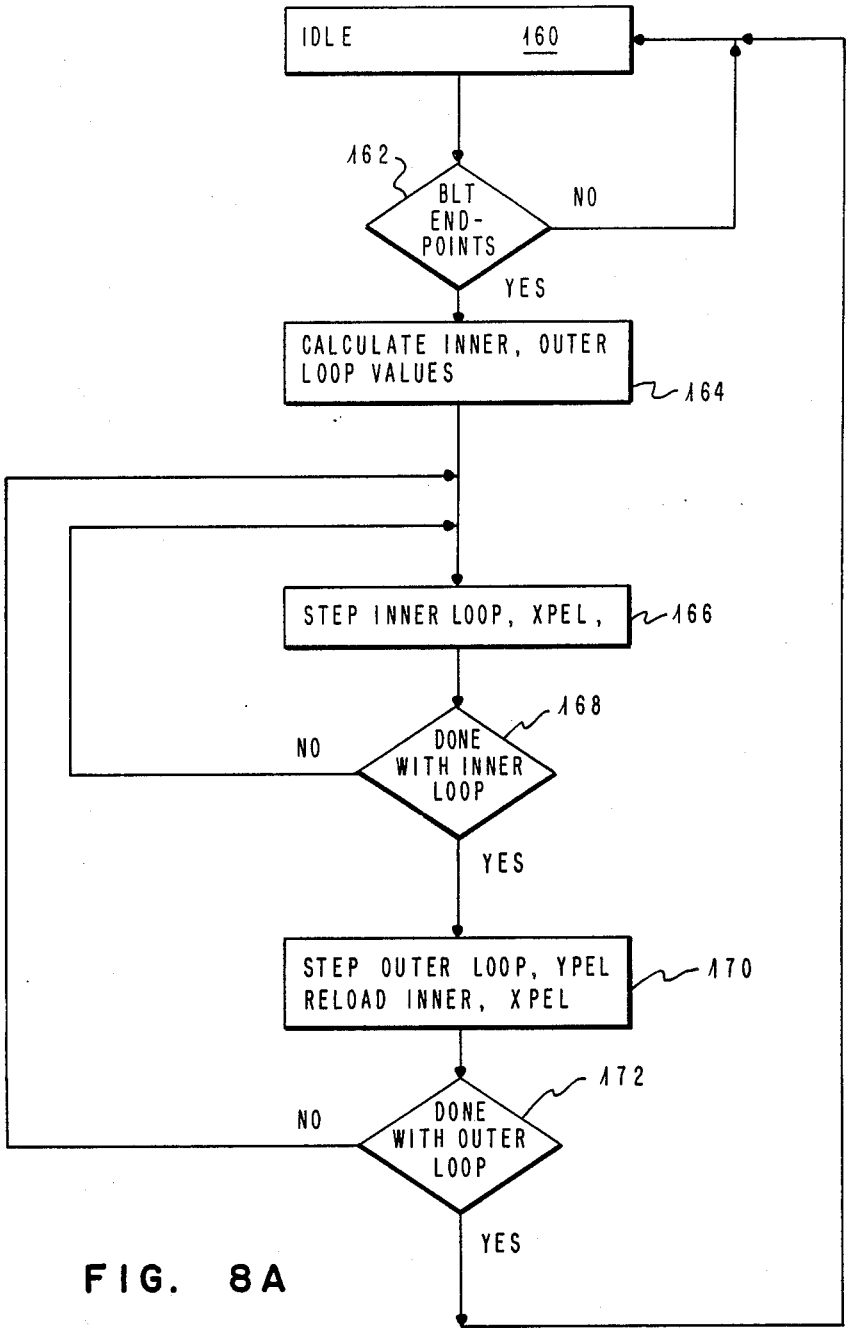
FIG. 8A is a flow diagram for the bit block transfer function task.

FIG. 8A is a software flow diagram illustrating the bit block transfer function. The pel processor 18 is in the idle state 160 until it receives the bit block transfer end points as illustrated in step 162. If the end points have not yet been received, the pel processor 18 remains in a idle state 160 searching for the end points. When the end points have been received, the pel processor 1 proceeds to step 164 to calculate the inner and outer loop values. In 166 the inner loop incrementing begins with the X pel address being incremented. In step 168 a decision is made as to whether or not the inner loop has been completed. If the inner loop has not been completed, the processor 18 returns to step 166. If the inner loop has been completed, the processor 18 proceeds to step 170 to step the outer loop set the Y pel and reload the inner loop counter. In step 172, a decision is made as to whether or not the outer loop has been completed. If the outer loop has not been complete, then the pel processor 18 returns to step 166. If so, the pel processor 18 returns to the idle state 160.

Figure 8B:
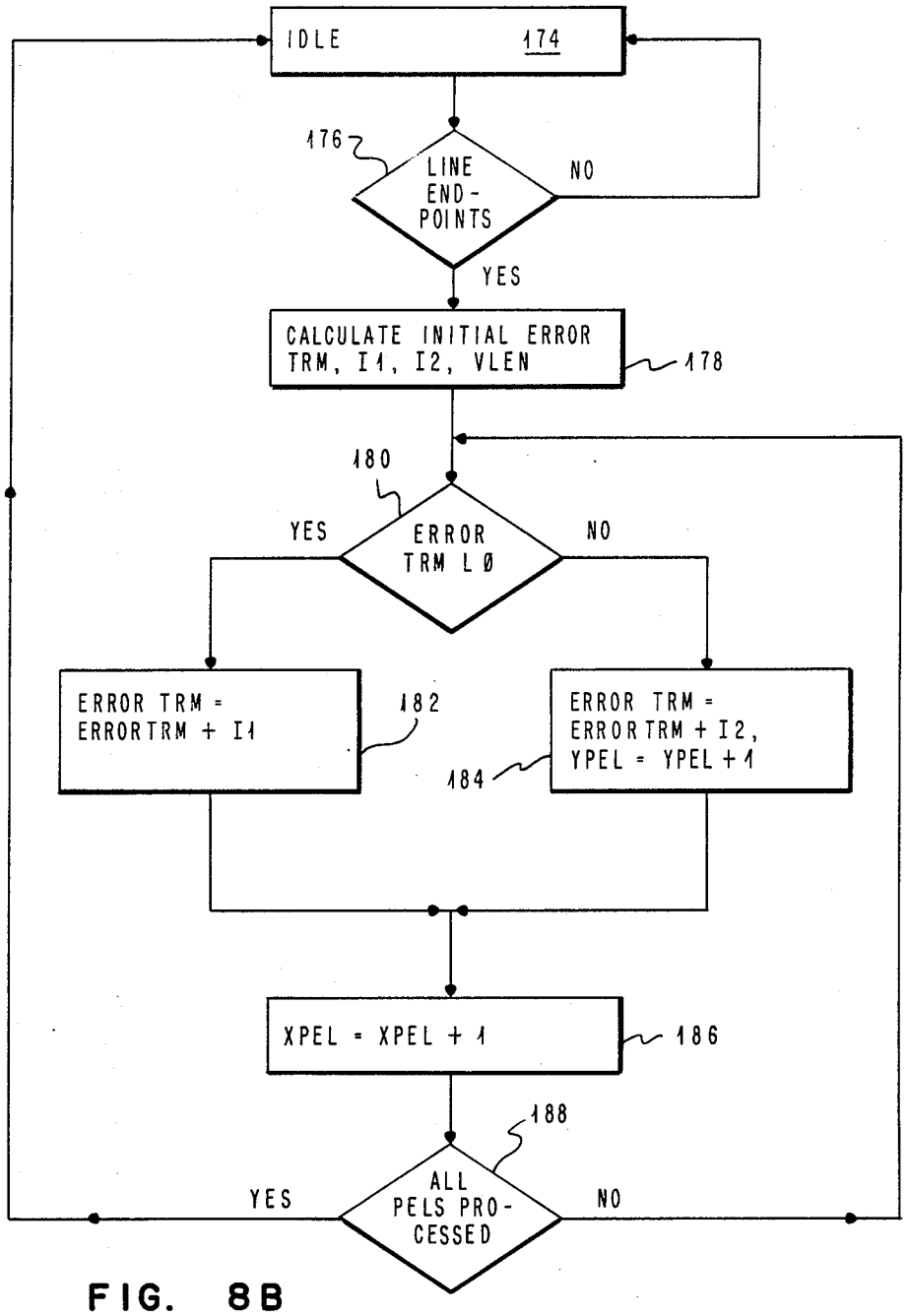
FIG. 8B is a flow diagram fir a line draw task.

FIG. 8B illustrates a flow chart for the Bresenham line draw algorithm. The Bresenham algorithm has disclosed in the *Fundamentals of Interactive Computer Graphics* by James D. Foley and Andries Van Dam, published by Addison Wesley Publishing Company, 1982 and appearing on pages 433–435. An over simplified explanation of the Bresenham algorithm is that it determines which picture elements in an array of picture elements should be illuminated to represent an approximation of a straight line in this array of picture elements. Basically the algorithm uses the slope between the two end points to determine a set of parameters that are used to designate which pels are to be activated. In FIG. 8B, the pel processor 18 initially loops between an idle state 174 and a decision state 176 until the line end points have been received. When the line end points have been received, the processor 18 proceeds to step 178 to calculate an initial error term, I1, I2, and the line length. The processor 18 then proceeds to step 180 to determine if the error term is less than 0. If not, the pel processor 18 proceeds to step 184 where the error term is added to I2 and the Y pel address is incremented. The pel processor 18 proceeds to steps 186 to increment the X pel. A decision is made in step 188 to determine if all the pels have been processed. If not, the processor 18 returns to step 180 to examine the error term. If the error term is less than 0, then the processor 18 proceeds to step 182 to add the constant I1 to the error term. The pel processor 18 then proceeds to step 186 as before. When it is determined that all the pels have been processed (step 188), the processor 18 returns to the idle state 174. It should be understood that the slope of the line to be drawn and its direction will determine which address counter is being conditionally counted.

Figure 9:
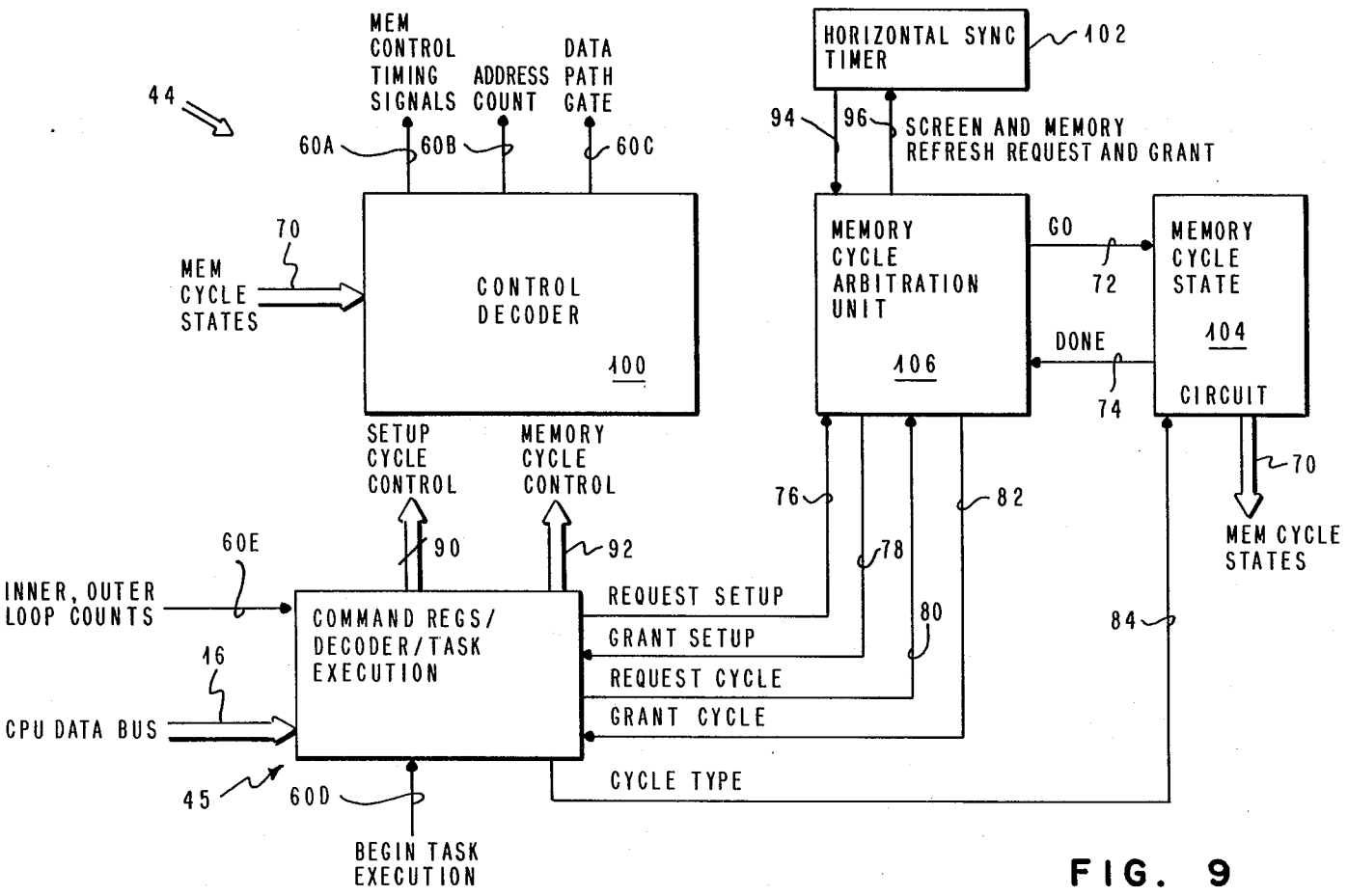
FIG. 9 is a block diagram of the pel processor 18 control circuitry.

In FIG. 6, the control logic 44 controls the internal operation of the pel processor 18. The control logic is connected to the system processor 10 and the digital signal processor 14 by bus 16. The control logic 44 provides control signals on line 60 to various other blocks illustrated in FIG. 6. FIG. 9 illustrates in greater detail the contents of control logic 44. A section of this control logic illustrated in FIG. 6 is a block 45 that is illustrated in FIG. 9 as a functional control circuit 45 containing command registers, decoding circuitry and task execution circuitry. Controller 45 is connected to control decoder circuitry 100. Controller 45 is further connected to a memory cycle arbitration unit 106 and a memory cycle state machine 104. The memory cycle arbitration unit 106 is connected to a refresh timer 102. The purpose of the circuitry in FIG. 9 is to perform a memory access setup cycle and a memory cycle task. During the setup cycle, addresses, control signals and data are being set to be transmitted on the next ensuing memory cycle. The actual interface with the memory (the bit map memory 22) is accomplished during the memory cycle task.

The control circuit 45 exercises a dynamic control over the executions of these tasks. The control registers contained in controller 45 are loaded from bus 16. These registers contain instructions that provide both commands for internal computation by the pel processor 18 and commands for the bit map memory 22. In operation the commands for the bit map memory 22 and the commands for the pel processor 18 are executed simultaneously. In the preferred embodiment controller 45 includes four instruction registers and further includes control circuitry that executes these four instructions in a looping fashion. In this embodiment four types of instructions may be executed These include read, write, load, store. The read and write instructions provide data access between the bit map memory 22 and the system processor 10 or digital signal processor 16 via the pel processor 18. The load and store instructions provide direct access between the bit map memory 22 and the pel processor 18.

When the instructions are loaded into controller 45, execution begins when a signal is received on line 60D. This signal is originated from block 40 (FIG. 6) signifying that all data has been loaded. The first instruction that is to be executed requires both setup cycles and memory cycles. At first control logic 45 determines if a setup is in progress on line 78. If no setup is in progress, then a setup cycle is requested by a signal on line 76 to the memory cycle arbitration unit 106. Likewise, during a memory cycle execution, the control circuitry 45 first determines if a memory cycle is in progress by examining the signal on line 82 and if not providing a signal on line 80 to initiate a memory cycle. During the execution of a setup cycle, setup control signals are provided on lines 90. During the execution of a memory cycle, memory cycle control signals are provided on lines 92. During the execution of either bit block transfer or line draw algorithms, the control circuitry 45 receives the inner and outer loop counts via lines 60E. Line 84 provides the instruction type currently being executed by the controller 45 to the memory cycle state circuit 104.

The function of the memory cycle arbitration unit 106 is to allocate time periods for the bit map memory 22, memory cycle refresh, screen refresh, cycle, setup cycle memory cycle and to determine when memory cycles and setup cycles are in progress. The memory cycle arbitration unit 106 is connected to the memory cycle state circuit 104 via lines 72 and 74 providing an initiation signal on line 72 and completion signal on line 74. The memory cycle state circuit 104 provides the memory cycle state outputs on lines 70 to drive the control decoding circuit 100. The control decoding circuit 100 actually provides the memory control signals to the bit map memory 22. Additionally, control decoding circuitry 100 provides control signals to the remaining functional blocks in the pel processor 18 as illustrated in FIG. 6.

One additional function provided in FIG. 9 is that of refresh timing. Timer 102 is connected to the memory cycle arbitration unit 106 to provide a signal when memory refresh and screen refresh is required.

Figure 10:
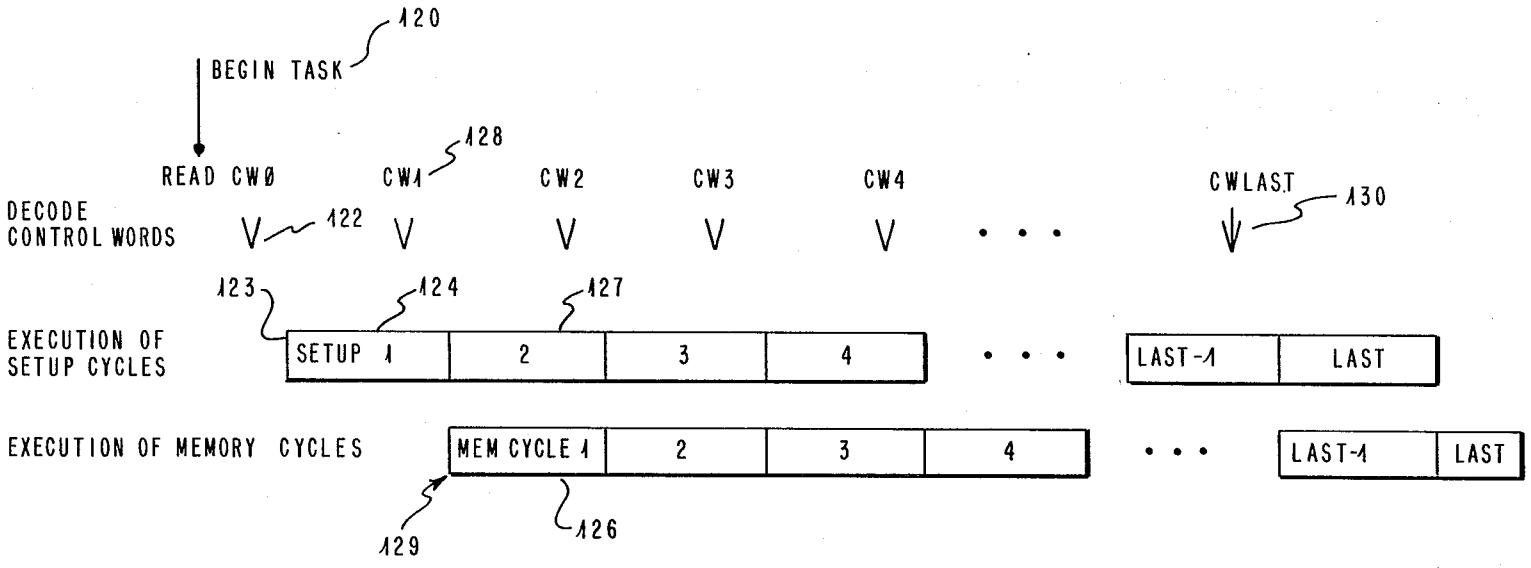
FIG. 10 is timing diagram illustrating the simultaneous executions of setup cycles and memory cycles.

FIG. 10 illustrates a timing diagram of the execution of setup cycles and memory cycles for the decoding of instructions and the control register contained in control circuitry 45. At a time 122 the first command is read and a setup cycle requested. At time 123 a setup cycle for the first instruction is begun. At time 129 the execution of the memory cycle for that first instruction is executed (126). At the same time of the execution of the memory cycle for the first instruction (126), the execution of the setup cycle for the second instruction is begun (127).

Figure 11:
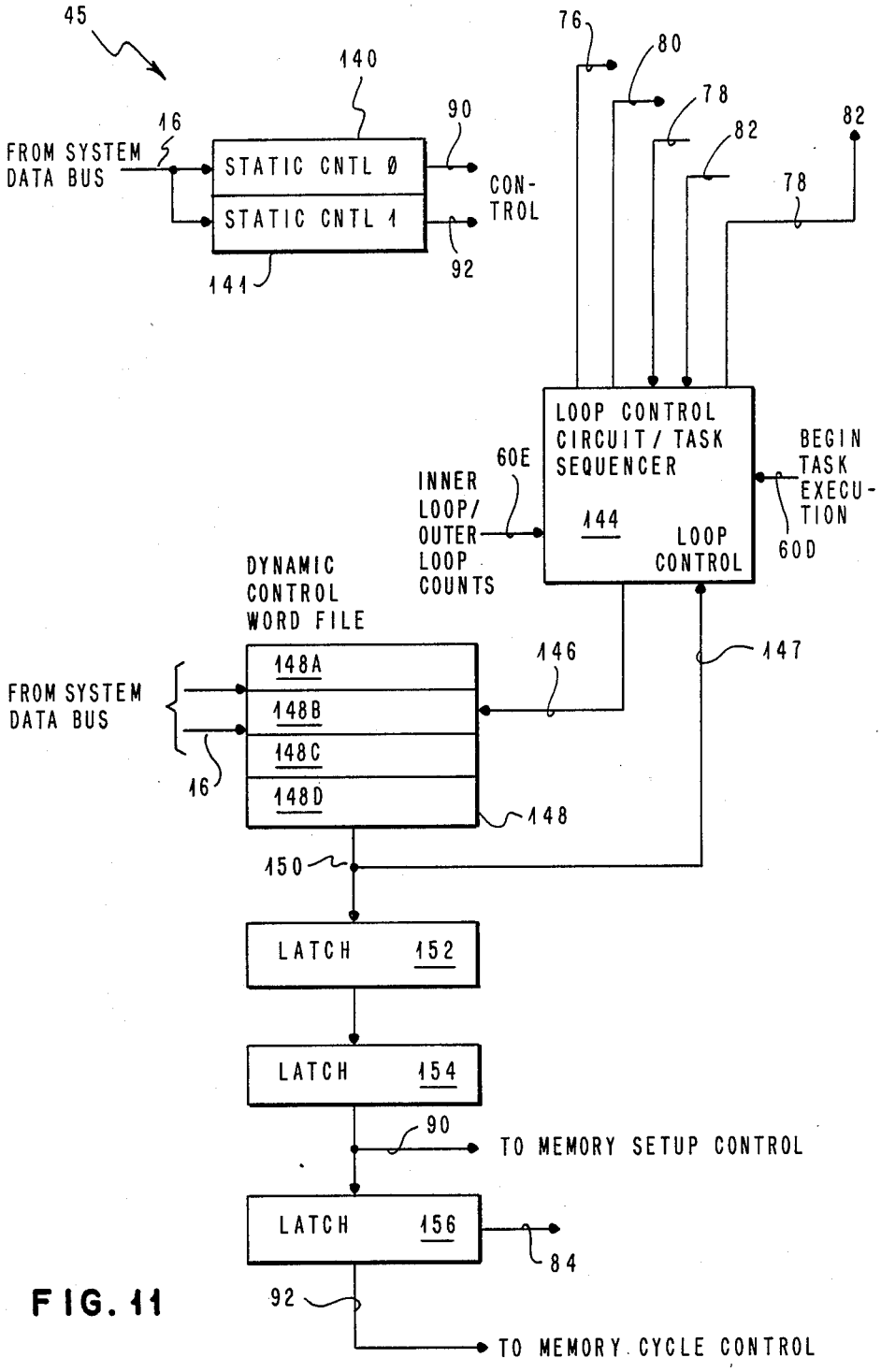
FIG. 11 is a block diagram of a section of the pel processor 18 control circuitry 45.

FIG. 11 illustrates the contents of control circuitry 45. Two registers 140 and 141 termed static control registers are contained in control circuitry 45 to maintain constant control signal data during the operation of the control circuitry 45. These constants are loaded from the bus 16. These registers provide outputs on lines 90 and 92 for the control decoder 100 (FIG. 9). The heart of the control circuitry 45 is the dynamic control instruction file 148 that includes four instruction registers 148A, 148B, 148C, and 148D. The execution of instructions contained in these four registers 148A–D is controlled by the loop control and task sequencer circuit 144. The sequencer 144 receives the begin task execution signal on line 60D and the inner loop/outer loop counts on line 60E. Furthermore, the sequencer circuit 144 provides the request setup signal on line 76 and the request memory cycle signal on line 80. It also receives the setup grant signal on line 78 and the memory cycle grant signal on line 82. The dynamic control instruction file 148 is connected to three latches 152, 154, and 156. When an instruction is to be executed, it is first latched into latch 152 by the sequencer 144. During the latching of this instruction sequencer 144 determines if it is a loop instruction via line 147. Data from register 148 is latched to latch 150 when the control word CW0 is read at time 122 (FIG. 10). The data from latch 150 is transferred to latch 154 at the start of the instruction setup cycle 123. Data from latch 154 is transferred to latch 156 at the beginning of the instruction memory cycle 129. The instruction is latched into latch 154. The instruction in latch 154 contains bits which supply signals on lines 90 designating the setup cycle control signals. These signals are provided to the control decoder 100 (FIG. 9). During the next fixed time period, when the same instruction that was in latch 154 is transferred into latch 156, it provides the memory cycle control signals on lines 92 and also a memory cycle designator on line 84 to the memory cycle state machine. Therefore, during any given fixed time period, control signals are being provided on lines 90 and 92 simultaneously.

Figure 12:
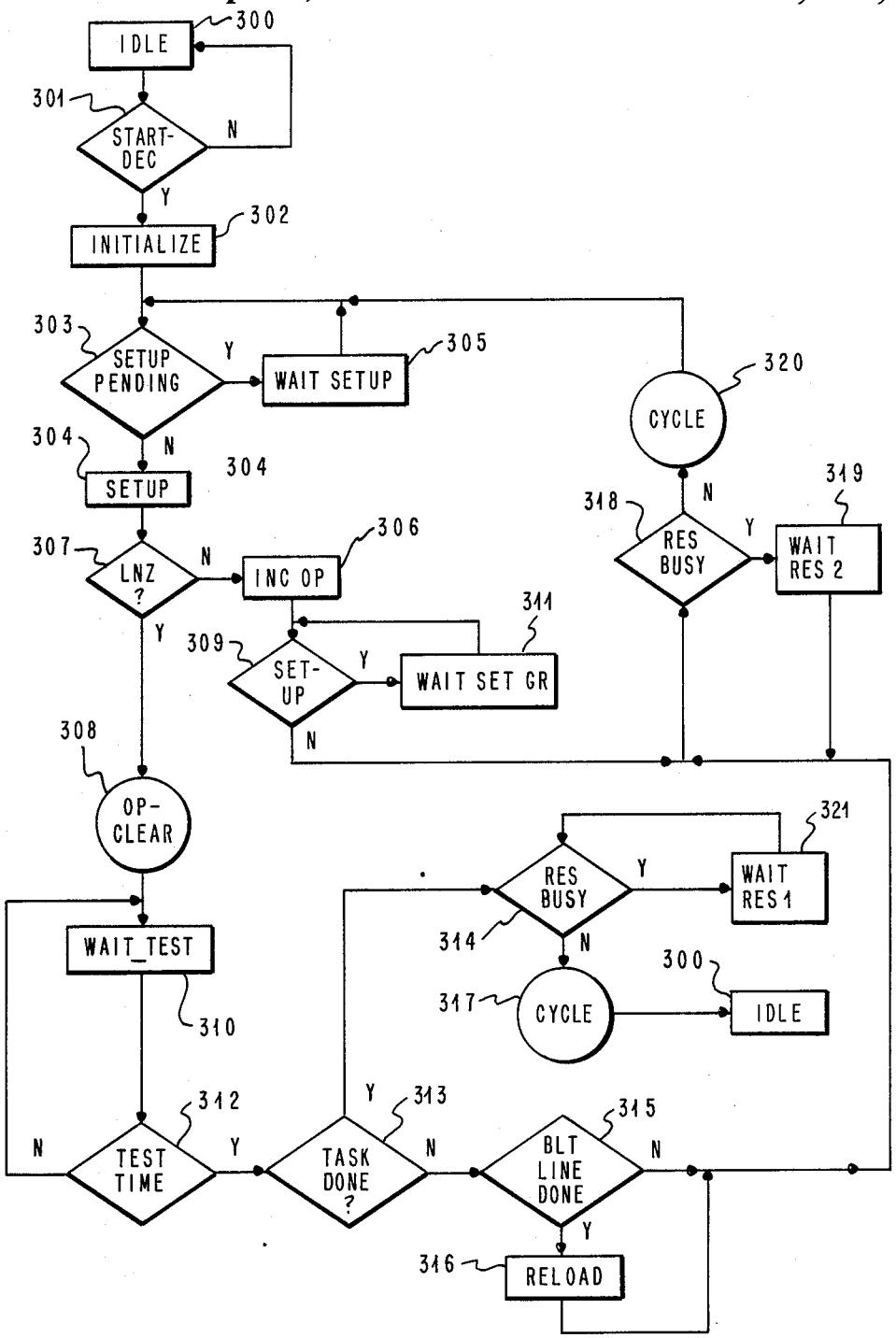
FIG. 12 is a flow diagram illustrating the operation of the control circuitry in FIG. 11.

FIG. 12 is a flow chart illustrating the operation of the control circuitry 45. In FIG. 12 the control circuitry 45 first enters an idle state 300 until it receives the start signal on line 60D. Steps 301 and 300 are repetitively executed until the start signal on lines 60D is received. When the start signal is received, step 302 is executed which initializes certain registers. In step 303, the control circuitry determines from examining line 78 whether a setup cycle is pending. If so, step 305 is executed where the controller waits until the cycle is complete. If no setup cycle is pending, the controller 45 proceeds with step 304 to request a setup cycle by placing a signal on line 76. In step 307, the controller determines if the instruction contained within the latch (152) requires looping. If not, the instruction counter is incremented in step 306 and a determination as to whether the setup cycle has been granted via line 78 is made. If the setup cycle has not yet been granted, then the controller waits in step 311 until this process is granted. And then the controller proceeds to step 318 where it determines if certain control circuitry is busy due to requirements from the system processor 10 or the signal processor 14. If so, then the controller waits in step 319 until the this circuitry is not busy. The execution of the load and store instructions will not require any interface by the system processor 10 or the signal processor 14 and therefore the controller 45 will always pass through this state when executing load and store instructions. If the circuitry is not occupied with communications with the signal processor 14 or the system processor 10, controller proceeds to step 320 to initiate the memory cycle. This is accomplished by first looking at the grant line 82 to determine if the memory cycle is in progress, if not then the memory cycle is requested by placing a signal on line 80. The controller then returns to step 303.

Returning to step 307 if a loop instruction is to be executed, the instruction counter is cleared in step 308 to insure that this execution is looped. In step 310 the controller waits until an indication that it can test the counter state. These counters are contained in block 50 (FIG. 6) and are providing the address counting for the bit block transfer algorithm and line draw algorithm. In step 312 a decision is made whether it is time to test it, if not, the controller loops back to step 310. When the counters can be tested, the controller proceeds to step 313 to determine if the task has been accomplished. If not, the controller proceeds to step 315 to determine if a bit block transfer line has been completed. In other words, if the inner loop counting is complete for this transfer. If so, then the inner loop counter is reloaded in step 316 and the outer loop counter is decremented. If not, or after step 316 has been accomplished, the controller proceeds to step 318 previously discussed.

Returning to step 313, if the task has been completed the controller proceeds to decision step 314 to determine if the the controller 45 is interfacing to either the system processor 10 or the signal processor 14. This wait step is 32 which is similar to step 319 previously discussed. If the circuitry is not busy the controller proceeds to step 317 which is similar to set 320 in the initialization of the memory cycle. The controller then proceeds back to the idle step 300.

Figure 13:
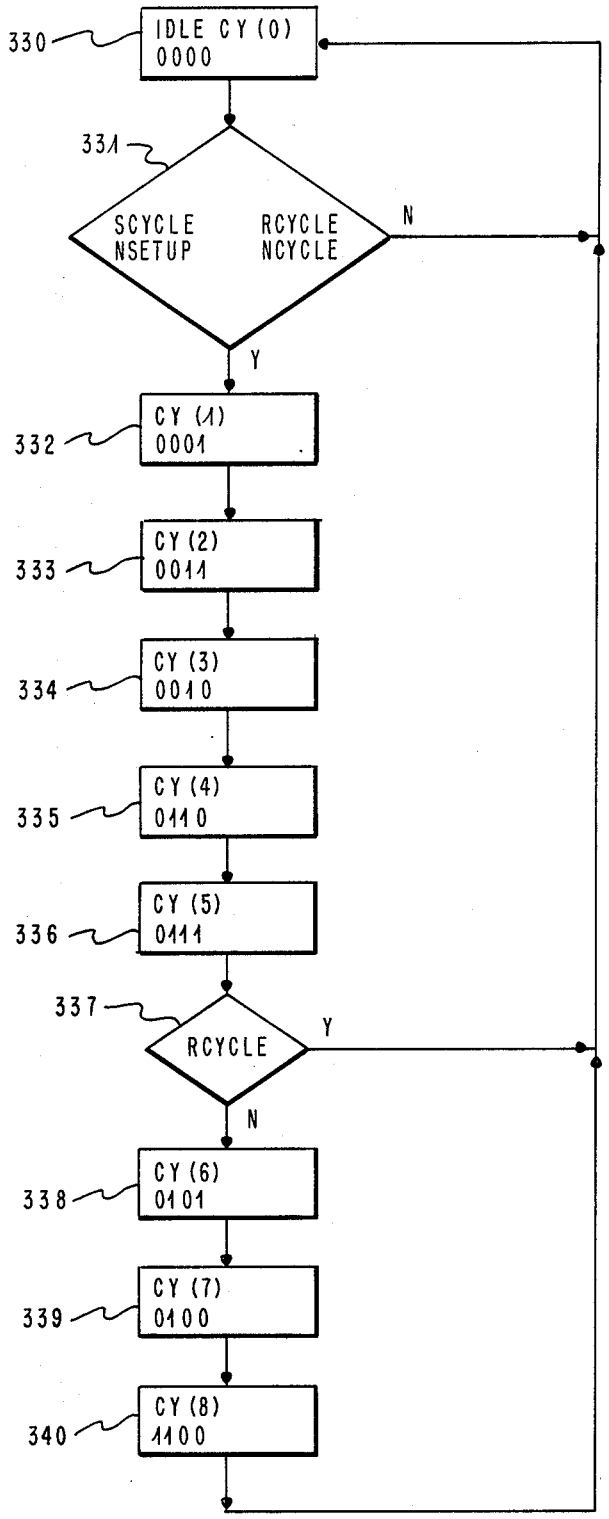
FIG. 13 is a flow chart illustrating the operation of the memory cycle state circuit 104.

The memory cycle state circuit 104 will sequentially provide one of eight states. FIG. 13 is a flow chart illustrating the operation of the memory cycle state circuitry 104. This state circuitry 104 initially starts in step 330 in idle until it receives a signal on line 72 from the memory cycle arbitration unit 106. A decision is made in step 331 when this signal has been received. When such a signal is received, the memory state circuitry 104 then sequentially provides five states 332–336. In step 337 it is determined whether or not the cycle that has been requested is a memory refresh cycle. If so, then the state circuitry 104 returns to idle state 330 and if not the state circuitry 104 provides steps 338–340. It should be understood that these eight states from the memory state circuitry 104 provide information for both the setup cycle and memory access cycles. The state condition output from state circuitry 104 is provided on lines 70 to the control decoder 100.

Figure 14:
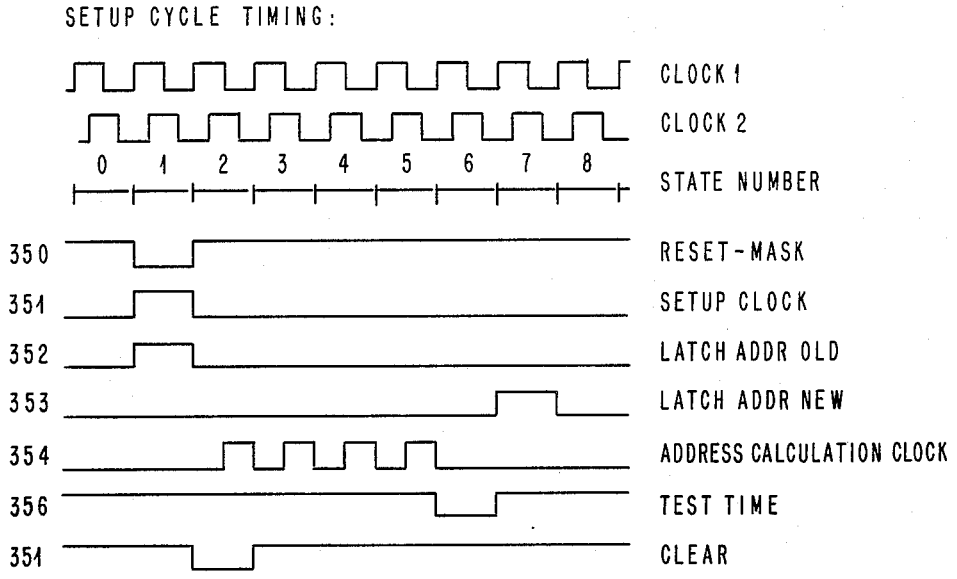
FIG. 14 is a timing diagram illustrating the control signals provided by the pel processor 18 control circuitry for a setup cycle.

FIG. 14 illustrates the output signals from the control decoder 100 for each of the eight states for a setup cycle. During state 1 a reset line 350 is dropped to reset the mask for the write enable control signals. The write enable control signals are used to control not only timing of the memory access but also to control which bits of the provided data is written into memory. The setup clock in line 351 is also activated as is a latch signal on line 352. Line 352 activates a latch to store the current or soon to be old address. Line 353 is activated during the seventh state to latch the new computed address. Line 354 is active during states 2, 3, 4 and 5 and provide clocking signals for the calculation of addresses. At the end of state 5, line 356 provides the test signal to the controller 45 to indicate that the counters can now be tested (i.e., step 312 in FIG. 12). In step 357 a clear signal is active during state 2 to provide the grant signal on line 78.

Figure 15:
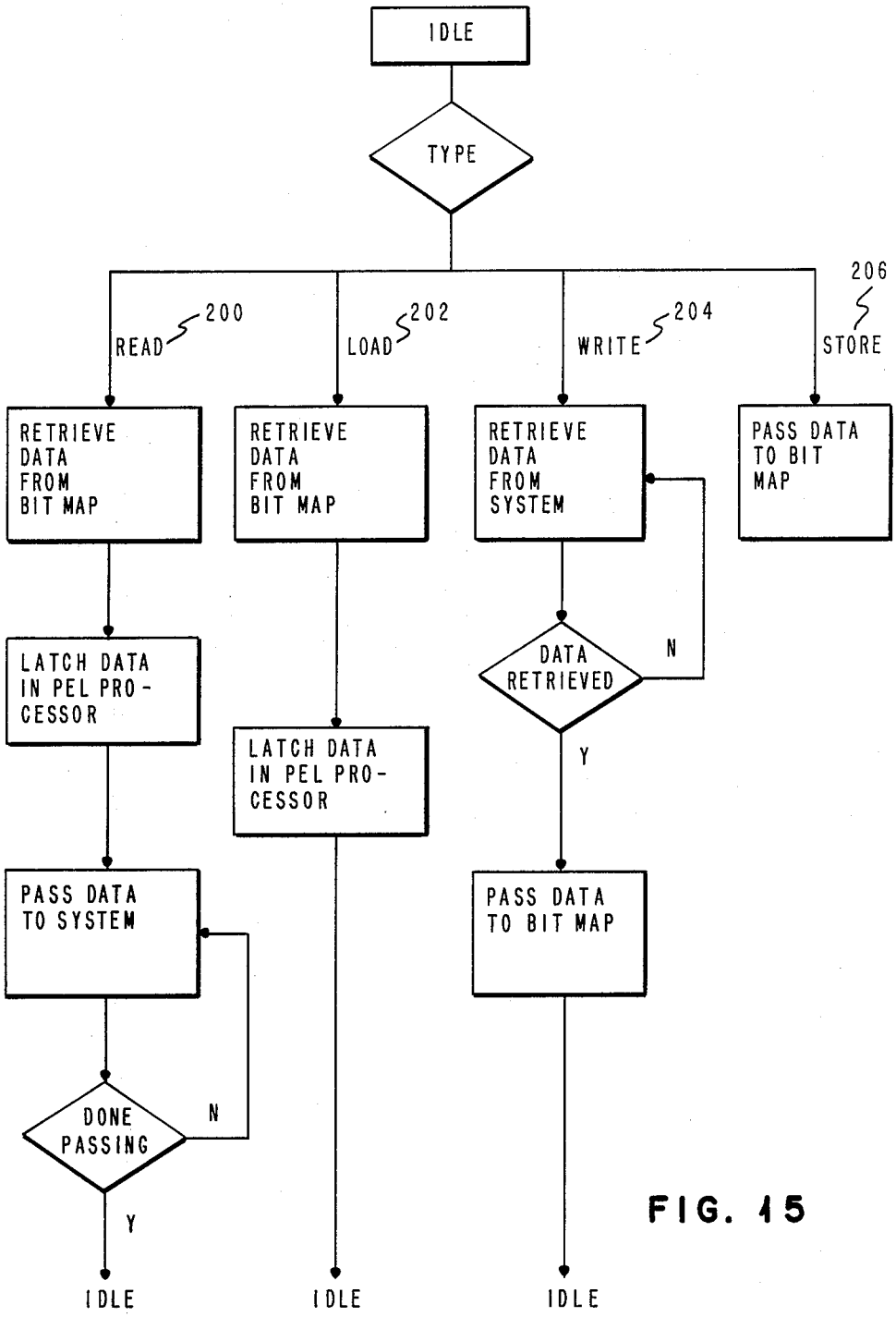
FIG. 15 is a flow diagram illustrating the operation of the control circuitry to execute a read, load, write and store instructions.

All of the instructions such as read, write, load and store include a setup cycle. All setup cycles are conducted in accordance with the timing diagram of FIG. 14. The read and write instructions entail access to either the signal processor 14 or the system processor 10. The load and store instructions only entail activities between the pel processor 18 and the bit memory 22. FIG. 15 is a flow chart illustrating the execution of the read, write, load and store instructions. To avoid confusion only the load and store instructions will be discussed since the read and write instructions do include load and store but also require interfacing to the system processor 10 or the signal processor 14.

Figure 16:
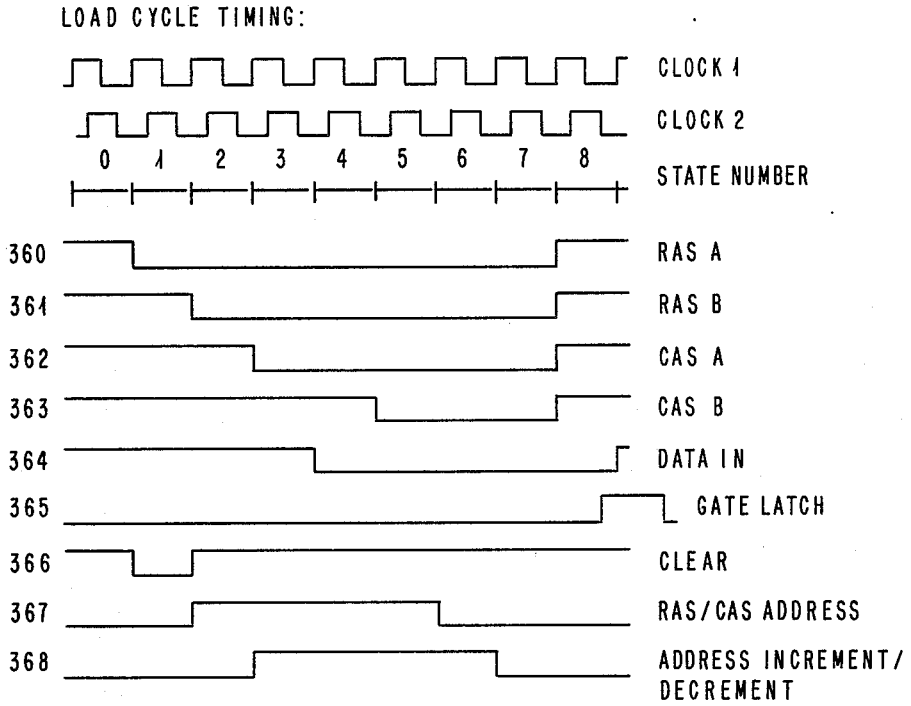
FIG. 16 is a timing diagram illustrating the control signals provided by the pel processor 18 control circuitry for a memory cycle load.
Figure 17:
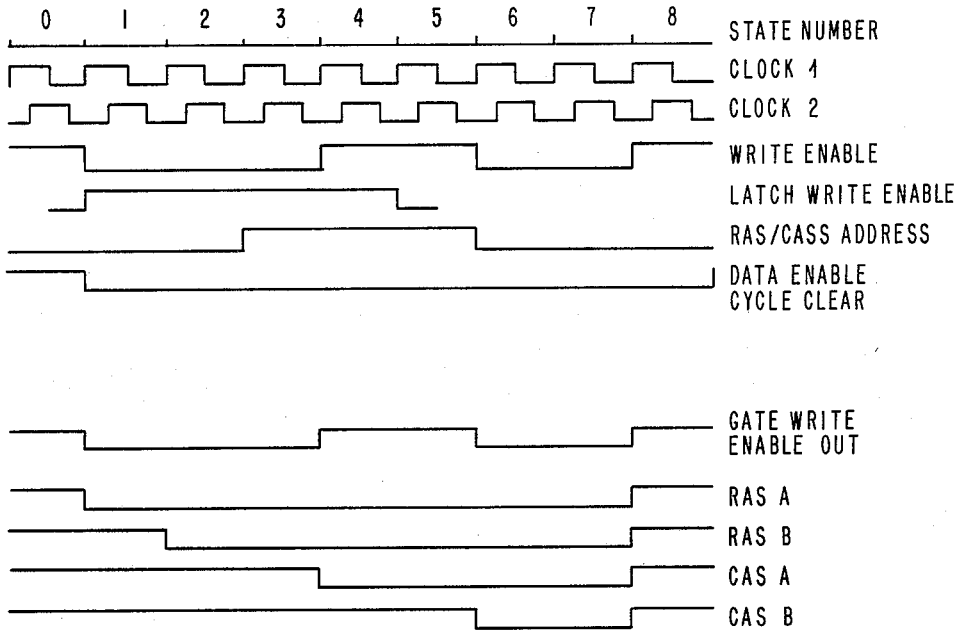
FIG. 17 is a timing diagram illustrating the control signals provided by the pel processor 18 control circuit for a memory cycle store.

The timing diagrams for the load and store instructions are provided in FIGS. 16 and 17. It should be understood that these cycles are similar to the setup cycle timing in FIG. 14. However, the control signals provided by the control decoder 100 are as illustrated in FIGS. 16 and 17 as a result of the states of the memory cycle state circuit 104. Referring to FIG. 16, two row address strobe timing signals 360 and 361 and two column address strobe timing signals 362 and 363 are provided to access the bit map memories. Line 364 is provided to pass data from the memory into the pel processor 18. Line 365 is a data latch signal. Line 366 provides the memory cycle grant on line 82. Line 367 designates the availability of the row address and column address signals. Line 368 is used in column and row address calculations.

FIG. 17 is the timing diagram for a store cycle and is similar to FIG. 16 and will not be discussed further.

Figure 18:
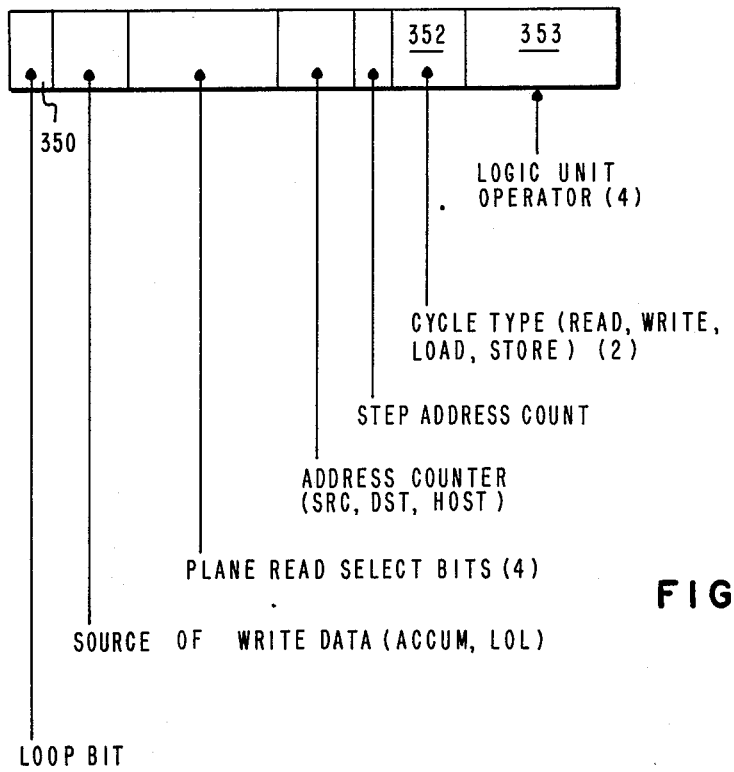
FIG. 18 is a bit format for a control instruction.

FIG. 18 is a bit format listing for instructions that are contained in the control registers 148. Bit position 350 specified whether or not the instruction is a loop instruction. This is used in decision step 307 of FIG. 12. Bit positions 352 specify the instruction type, i.e., read, write, load or store. This is used to provide the signal on line 84 (FIG. 9). Bit positions 353 specify the data paths to be activated in the data path merge logic 54.

Figure 19:
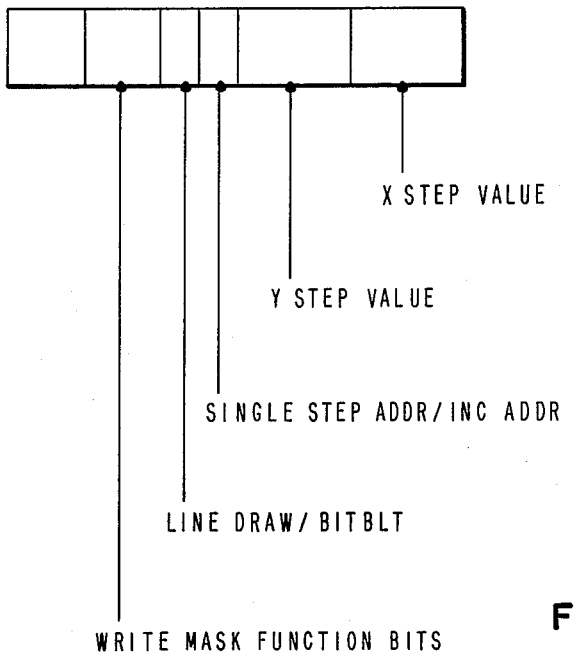
FIG. 19 is a bit format for the first static control register.

FIG. 19 illustrates the bit formats for the contents of the static control register 140. These bits provide information to the control decoder 100 (FIG. 9) on lines 90 for the setup cycle.

Figure 20:
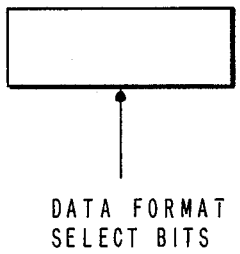
FIG. 20 is a bit format for the second static control register.

FIG. 20 provides the data format for the static control register 141. These bits specify the types of memory access to the control decoder 100 on the memory cycle control lines 92.

Figure 21:
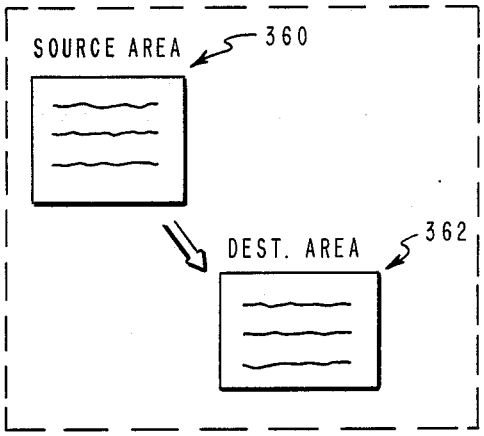
FIG. 21 illustrates a bit block transfer.
Figure 22:
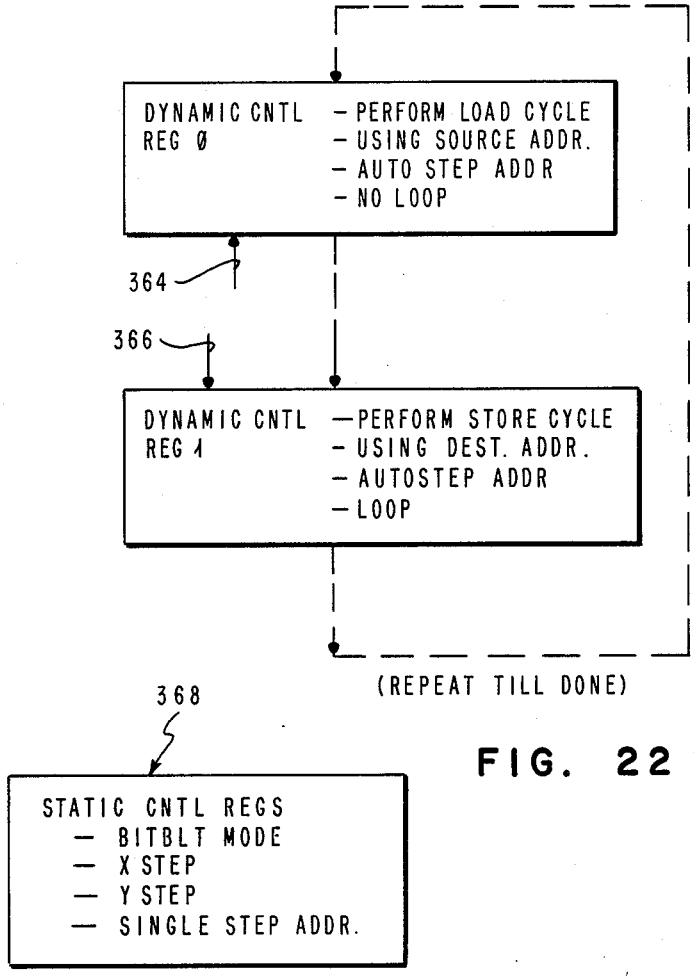
FIG. 22 illustrates the instructions and the contents of the static control registers for the execution of a bit block transfer.

In FIG. 21 an illustration is given of a bit block transfer of information from a source area 360 to a destination area 362. In FIG. 22 the contents of the control instruction register 148 is illustrated to accomplish this transfer of FIG. 21. Two instructions are required as illustrated by instructions 364 and 366 operating in a loop fashion. The contents of the static control registers 140 and 141 are illustrated in block 368.

Figure 23:
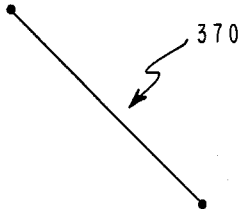
FIG. 23 illustrates a line draw function.
Figure 24:
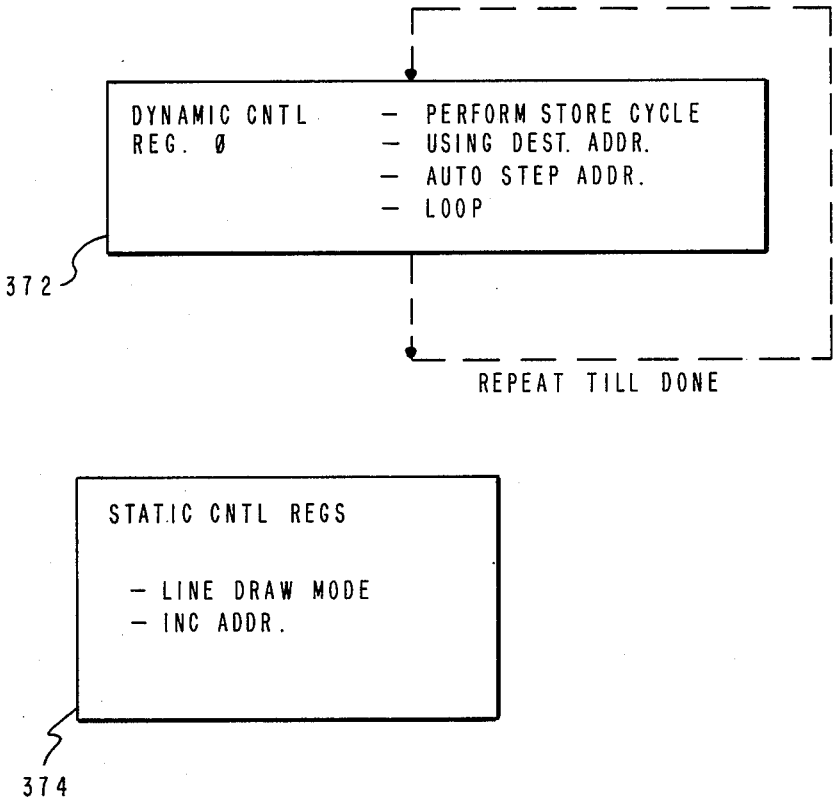
FIG. 24 illustrates the instruction and the content of the static control registers for the execution of a line draw function.

FIG. 23 illustrates the drawing of a single line 370. In FIG. 24 this is accomplished by a single instruction in the control register 148 consisting of an instruction illustrated as 372. The contents of the static control registers 140 and 141 are illustrated in block 374.

Figure 25A:
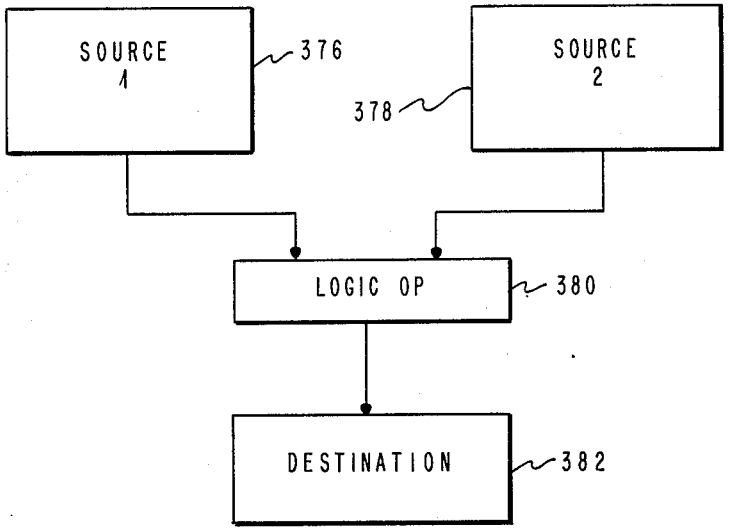
FIG. 25A illustrates a bit block transfer operation including the logical combination of two bit blocks.
Figure 25B:
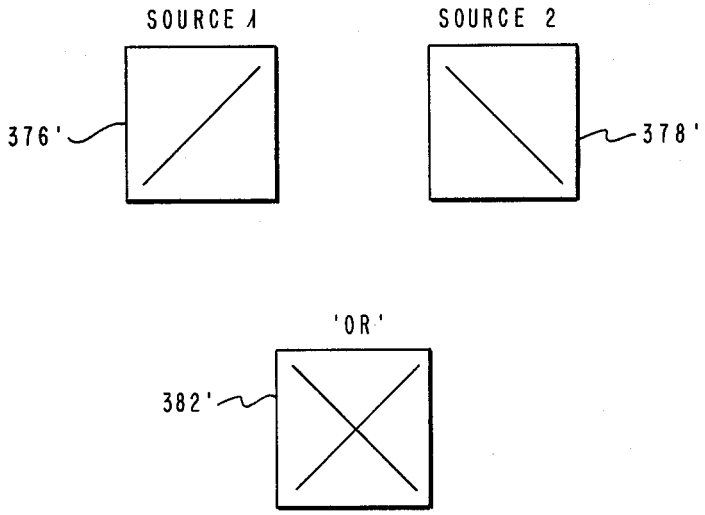
FIG. 25B is an illustration of the actual ORing of a bit block transfer illustrated in FIG. 25A.
Figure 26:
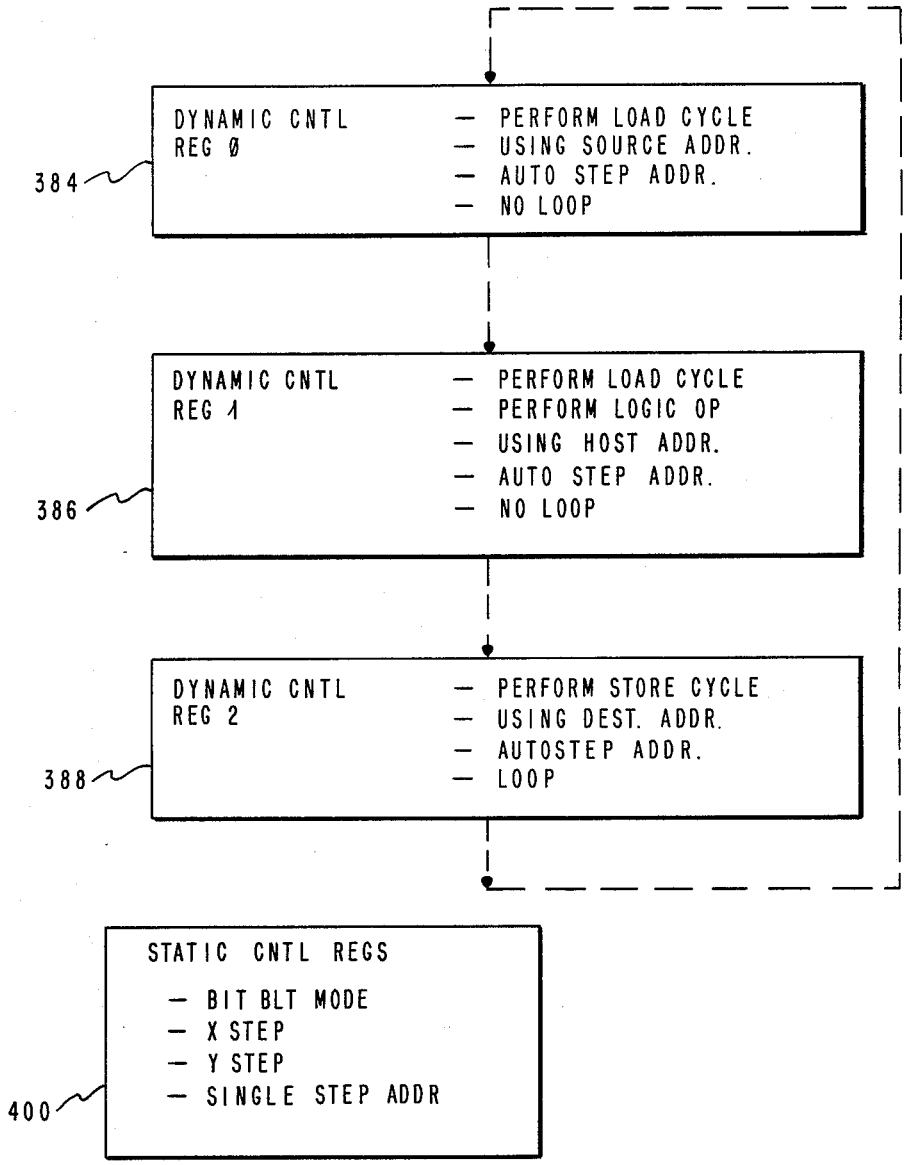
FIG. 26 illustrates the instructions and the contents of the static control registers for accomplishing the bit block transfer illustrated in FIGS. 25A and 25B.

FIG. 25A illustrates a bit block transfer operation including two source areas 376 and 378 that are combined in a logic operation 380 to provide a destination area 382. An example is illustrated in FIG. 25B combining the lines of 376' plus 378' in an OR operation to result in a composite screen 382'. To accomplish this task, the dynamic control register instructions are illustrated in FIG. 26 as blocks 384, 386 and 388. Contents of the static control registers 140 and 141 are illustrated in block 400.

Although this invention has been described with reference to this specific embodiment, this description is not meant to be construed in a limiting sense. Various modifications of the disclosed embodiment, as well as other embodiments of the invention, will become apparent to those persons skilled in the art upon reference to the description of this invention. It is, therefore, contemplated that the appended claims will cover any such modifications or embodiments as fall within the true scope of this invention.

We claim:

1. A processing system comprising:

external device means for executing an external device command, each external device command being executed within a fixed time cycle; and a processor means connected to said external device means for decoding processor means instructions, each instruction decoded to provide an external device means command and an internal processor command wherein said internal processor command is derived from the decoded instruction, a current state of the processor means, and a signal from said external device means indicating a current state of the external device means, said processor means including means for providing said external device command to said external device means and simultaneously executing said internal processor command within the same fixed time cycle.

2. A processing system according to claim 1 wherein said internal commands are performed in series in said processor means during the performance of said external command by said external device.

3. A processing system according to claim 2 wherein said series of internal commands are performed within the fixed time period.

4. A processing system according to claim 3 wherein said processing system includes a register which specifies the external and internal commands.

5. A processing system comprising:

an external memory for retaining data and including means for executing memory commands for storing and retrieving said data, each memory command being executed during a single fixed time cycle and for providing a signal indicative of the state of command execution; and processor means connected to said memory means for decoding processor means instructions, each instruction decoded to provide a memory command and an internal processor command wherein said internal processor command is derived from the decoded instruction, a current state of the processor means, and said external memory signal, said processor means including means for providing said memory command to said external memory and simultaneously executing said internal processor command within the same fixed time cycle.

6. A processing system according to claim 5 wherein said internal commands are performed in series in said processor means during the performance of said external command by said external memory.

7. A processing system according to claim 6 wherein said series of internal commands are performed within the fixed time period.

8. A processing system according to claim 7 wherein said processing system includes a register which specifies the external and internal commands.

9. A processing system according to claim 8 wherein said internal processing means commands include commands that compute address information for the memory.

10. A graphics display system comprising:

a system processor means for computing graphics information to be displayed;

a graphics processor means connected to the system processor means for receiving said graphics information and for computing picture element data for display;

a graphics memory means connected to said graphics processor means for receiving and storing said picture element data;

a display means connected to said graphics memory means for displaying said picture element data from said graphics memory means;

wherein said graphics memory means includes means for executing memory commands for storing and retrieving said picture element data, each memory command being executed during a single fixed time cycle and for providing at least one graphics memory signal indicating the state of memory command execution to said graphics processor means, and said graphics processor means includes means for decoding graphics processor means instructions, each instruction decoded to provide a memory command and an internal graphics processor command wherein said internal graphics processor command is derived from the decoded instruction, a current state of the graphics processor means, and said graphics memory signal, said graphics processor means including means for providing said memory command to said graphics memory means and simultaneously executing said internal processor command within the same fixed time cycle.

11. A graphics display system according to claim 10 wherein said internal commands are performed in series in said graphics processor means during the performance of said memory command by said graphics memory means.

12. A graphics display system according to claim 11 wherein said series of internal commands are performed within the fixed time period.

13. A graphics display system according to claim 12 wherein said graphics processor means includes at least one register which specifies the memory and internal commands.

14. A graphics display system according to claim 13 wherein said internal commands include commands that compute address information for the graphics memory means.

15. A graphics display system according to claim 14 wherein said graphics processor means includes a control means connected to at least two registers for executing said instructions in said registers in a serial loop.

16. A graphics display system according to claim 15 wherein said control means connected registers receive instructions from said system processor means.

17. A graphics display system according to claim 16 wherein said control means connected registers are connected to a plurality of serially connected latches each connected to respective decoding circuit means, said latches for receiving instructions from one of the control registers from said control means and for providing its instruction to its respective decoding circuit means for providing a plurality of control signals simultaneously specifying memory commands and internal processor commands.

18. A graphics display system according to claim 17 wherein each instruction within said control registers is serially circulated through said latches by said control means.

19. A graphics display system according to claim 18 wherein an instruction is loaded into a latch each fixed time period.

20. A processor comprising:

means for providing a first command decoded from an instruction to an external device for execution in a fixed time cycle;

means for receiving a signal from said external device indicating the state of command execution; and means for decoding a second command from said instruction, a current state of the processor and said external device signal and for executing said second command simultaneously and concurrently with the execution of said first command in the same fixed time cycle.

* * * * *